US011959691B2

(12) United States Patent
Kwon et al.

(10) Patent No.: US 11,959,691 B2
(45) Date of Patent: Apr. 16, 2024

(54) REFRIGERATOR AND HOME APPLIANCE

(71) Applicant: LG Electronics Inc., Seoul (KR)

(72) Inventors: Omin Kwon, Seoul (KR); Sanghyun Cheon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/859,457

(22) Filed: Jul. 7, 2022

(65) Prior Publication Data

US 2023/0010034 A1 Jan. 12, 2023

(30) Foreign Application Priority Data

Jul. 7, 2021 (KR) ..... 10-2021-0089384

(51) Int. Cl.
*F25D 23/02* (2006.01)
*F25D 23/10* (2006.01)

(52) U.S. Cl.
CPC ..... *F25D 23/028* (2013.01); *F25D 23/10* (2013.01); *F25D 2400/18* (2013.01)

(58) Field of Classification Search
CPC .... F25D 23/028; F25D 23/10; F25D 2400/18; F25D 23/02; F25D 11/00; E06B 3/7001; E06B 5/006; E06B 2003/7011; E06B 2003/7049
See application file for complete search history.

(56) References Cited

U.S. PATENT DOCUMENTS 4,949,520 A * 8/1990 Bear ..... A47B 95/002 52/287.1
5,358,326 A * 10/1994 Cherry ..... F25D 23/02 312/265.6

(Continued)

FOREIGN PATENT DOCUMENTS

CN 113446788 9/2021
CN 113865232 A * 12/2021

(Continued)

OTHER PUBLICATIONS

Extended Search Report in European Appln. No. 22183537.4, dated Nov. 25, 2022, 8 pages.

(Continued)

*Primary Examiner* — Hanh V Tran
(74) *Attorney, Agent, or Firm* — Fish & Richardson P.C.

(57) ABSTRACT

A refrigerator includes a cabinet and a door. The door includes a door body filled with an insulator and a door panel detachably mounted on the door body. The door panel includes a panel defining a front appearance of the door, and a panel bracket disposed on a rear surface of the panel and including a mounting protrusion protruding rearward. The door body includes a cap deco that defines a portion of a perimeter surface of the door body and includes a protrusion accommodating part receiving the mounting protrusion, and a deco cover that shields an opening of the cap deco and includes a restraining protrusion protruding into the cap deco. The restraining protrusion is in contact with the protrusion accommodating part when the deco cover is mounted and maintains a restrained state of the mounting protrusion and the protrusion accommodating part.

18 Claims, 22 Drawing Sheets

(56) References Cited

U.S. PATENT DOCUMENTS

| | | | | |
|---|---|---|---|---|
| 5,571,276 | A * | 11/1996 | Kobos | A47L 15/4265 312/265.5 |
| 5,603,557 | A * | 2/1997 | Marks | A47L 15/4265 312/265.6 |
| 6,557,956 | B2 * | 5/2003 | Hightower | A47B 47/05 24/297 |
| 7,178,886 | B2 * | 2/2007 | Hightower | F16B 12/26 312/265.5 |
| 7,954,345 | B2 * | 6/2011 | Park | D06F 39/14 68/139 |
| 8,485,615 | B2 * | 7/2013 | Ciyanoglu | F25D 23/10 312/204 |
| 10,907,884 | B1 * | 2/2021 | Scorsim | F25D 23/028 |
| 11,029,079 | B1 * | 6/2021 | Lee | F25D 23/126 |
| 11,047,613 | B1 * | 6/2021 | Park | F25D 23/02 |
| 11,320,192 | B2 * | 5/2022 | Lee | E06B 3/4627 |
| 11,402,147 | B2 * | 8/2022 | Lee | F25D 23/02 |
| 2007/0188059 | A1 * | 8/2007 | Davis | F25D 23/02 312/265.6 |
| 2012/0169196 | A1 * | 7/2012 | Marchetti | E06B 5/006 312/265.6 |
| 2016/0341468 | A1 * | 11/2016 | Joo | F25D 11/02 |
| 2017/0370631 | A1 * | 12/2017 | Kim | F25D 23/006 |
| 2018/0187955 | A1 * | 7/2018 | Son | F25D 23/028 |
| 2020/0072544 | A1 * | 3/2020 | Lee | F25D 29/005 |
| 2020/0284503 | A1 * | 9/2020 | Gerstmayr | F25D 23/028 |
| 2020/0323342 | A1 * | 10/2020 | Chavan | F25D 25/02 |
| 2020/0326119 | A1 * | 10/2020 | Lee | F25D 23/028 |
| 2021/0055038 | A1 * | 2/2021 | Lee | F25D 23/028 |
| 2021/0071934 | A1 * | 3/2021 | Lee | E06B 3/4627 |
| 2021/0372688 | A1 * | 12/2021 | Kang | F25D 23/02 |
| 2021/0396456 | A1 * | 12/2021 | Park | F25D 23/067 |
| 2021/0396458 | A1 * | 12/2021 | Moon | A47B 96/20 |
| 2022/0003494 | A1 * | 1/2022 | Kwon | F25D 25/005 |

FOREIGN PATENT DOCUMENTS

| | | | |
|---|---|---|---|
| EP | 3809072 | A1 | 4/2021 |
| JP | H0791816 | A | 4/1995 |
| JP | 2016-156556 | A | 9/2016 |
| JP | 6460832 | | 1/2019 |
| KR | 10-1124410 | | 3/2012 |
| KR | 10-1520691 | | 5/2015 |
| KR | 10-2021-0156165 | | 12/2021 |
| WO | WO 2014/024429 | A1 | 2/2014 |
| WO | WO 2021/112658 | A1 | 6/2021 |
| WO | WO 2021/172948 | | 9/2021 |

OTHER PUBLICATIONS

Extended European Search Report in European Appln. No. 22217371.8, dated May 4, 2023, 9 pages.

Office Action in Australian Appln. No. 2022204877, dated Jun. 30, 2023, 6 pages.

Office Action in Korean Appln. No. 10-2021-0194293, mailed on Nov. 28, 2023, 10 pages (With English translation).

* cited by examiner

REFRIGERATOR AND HOME APPLIANCE

CROSS-REFERENCE TO RELATED APPLICATIONS

This application claims priority under 35 U.S.C. 119 and 365 to Korean Patent Application No. 10-2021-0089384, filed on Jul. 7, 2021, in the Korean Intellectual Property Office, the disclosure of which is incorporated herein by reference.

FIELD

The present disclosure relates to a refrigerator and a home appliance.

BACKGROUND

In general, a refrigerator is a home appliance for storing food at low temperature in an internal storage space that is shielded by a refrigerator door, and is configured to store the stored food in an optimal state by cooling the inside of the storage space using cold air generated through heat exchange with a refrigerant circulating through the refrigeration cycle.

Such a refrigerator is gradually being enlarged and multi-functional according to a trend of changes in dietary life and high-quality products, and a refrigerator equipped with various structures and convenience devices in consideration of user convenience is being developed.

In order to harmonize with an environment in which the refrigerator is disposed or with surrounding furniture or home appliances, structures for varying an outer appearance of a door front of the refrigerator are developed, and this situation is also applied to general home appliances in the same way.

Japanese Patent No. 6460832 discloses a structure in which a glass plane defining an outer appearance is mounted on a door front of a refrigerator. Disclosed is a structure in which a plurality of recessed grooves are formed in a front part of a door body, and a glass panel is mounted by forming an installation part bent in multiple stages on a rear surface of the glass panel and inserting the installation part into the recessed grooves. In addition, a structure in which an upper end of the glass panel is restrained by mounting a blocking part to limit upward flow of the glass panel is disclosed.

However, conventionally, a blocking part is fixedly mounted on a refrigerator door after the glass panel is mounted, and accordingly, there is a problem in that it is not possible to maintain a constant interval between the glass panel and the blocking part.

An end of the glass panel is separated from a covering part of a door front, and thus, there is a problem in that the glass panel is deformed or damaged when the glass panel is pressed from the front.

There is a problem in that the glass panel is damaged when an impact is applied to the end of the glass panel because a portion of a perimeter of the glass panel is exposed.

SUMMARY

An object of an embodiment of the present disclosure is to provide a refrigerator and a home appliance for improving the quality of assembly finish after a door panel is mounted.

An object of an embodiment of the present disclosure is to provide a refrigerator and a home appliance for improving the assembly workability of a door panel.

An object of an embodiment of the present disclosure is to provide a refrigerator and a home appliance for maintaining the state in which a door panel is firmly mounted.

According to an embodiment of the present disclosure, a refrigerator includes a cabinet with a storage space formed therein, and a door configured to open and close the storage space, and including a door body filled with an insulator and a door panel detachably mounted on the door body, wherein the door panel includes a panel defining a front appearance of the door, and a panel bracket disposed on a rear surface of the panel and including a mounting protrusion protruding rearward, wherein the door body includes a cap deco defining a portion of a perimeter surface of the door body, and including a protrusion accommodating part into which the mounting protrusion is inserted, and a deco cover mounted to shield an opening of the cap deco, and including a restraining protrusion protruding into the cap deco, and wherein the restraining protrusion is in contact with the protrusion accommodating part into which the mounting protrusion is inserted when the deco cover is mounted and maintains a restrained state of the mounting protrusion and the protrusion accommodating part.

The cap deco may have open front and upper surfaces, and may include a recess in which the protrusion accommodating part is formed, and the mounting protrusion may be inserted through the front surface when the door panel is mounted, and the restraining protrusion may be inserted through the upper surface.

The protrusion accommodating part may be elastically deformed in a direction crossing a direction in which the mounting protrusion is inserted, and the restraining protrusion may restrain an outer surface of the protrusion accommodating part and may limit elastic deformation of the protrusion accommodating part.

The protrusion accommodating part may include one pair of accommodating extensions spaced apart from each other, and the one pair of accommodating extensions may extend forward in a state in which rear ends thereof are fixed to the cap deco and may be elastically deformed to be press-fitted into a space between the pair of accommodating extensions.

An interval between front ends of the one pair of accommodating extensions may be smaller than a diameter of the mounting protrusion.

The one pair of accommodating extensions may be inclined or rounded to surround a perimeter surface of the mounting protrusion, and an interval between middle portions of the one pair of accommodating extensions may be larger than the interval between the front ends.

The mounting protrusion may include an extension extending rearward from a rear surface of the panel bracket, and an insert part formed at an end of the extension and press-fitted between the one pair of accommodating extensions.

The insert part may be formed with a larger width than the extension and may be formed with a width that is reduced toward front and rear ends compared with a central part.

The extension may be formed with a smaller width than the interval between the front ends, the insert part may be formed with a larger width than the interval between the front ends, and an outer surface of the insert part may be inclined or rounded to be in contact with inner surfaces of the one pair of accommodating extensions.

The restraining protrusion may extend in a direction crossing the one pair of accommodating extensions from the deco cover, and outer surfaces of the one pair of accommodating extensions may be restrained by being pressed.

The restraining protrusion may include one pair of restraining members arranged in parallel to be spaced apart from each other, and the one pair of accommodating extensions and the mounting protrusion may be disposed between the one pair of restraining members when a cover member is mounted.

The restraining member may extend along inner surfaces of the one pair of restraining members, which face each other, and a rib in contact with the outer surface of the accommodating extension may be formed.

The plurality of ribs may be spaced apart from each other, and a most protruding portion of the outer surface of the accommodating extension may be positioned between the ribs spaced apart from each other.

A protrusion height of the rib may be reduced as extending upward from a lower end.

The plurality of mounting protrusions may be continuously arranged in a direction in which the panel bracket extends, the protrusion accommodating parts may be formed to face the plurality of mounting protrusions, respectively, and the mounting protrusion may be disposed along a short side of a perimeter of the panel with a rectangular shape.

The door body may include a body cover defining a front surface of the door body, a door liner spaced apart from the body cover and defining a rear surface of the door body, an upper cap deco connecting an upper end of the body cover and an upper end of the door liner, a lower cap deco connecting a lower end of the body cover and a lower end of the door liner, and a side deco defining both surfaces of the door body, wherein the insulator may be filled in a space formed by coupling the body cover, the door liner, the upper cap deco, the lower cap deco, and the side deco, and an upper end and a lower end of the door panel may be restrained by the lower cap deco and the upper cap deco.

The cap deco may include an upper cap deco defining an upper surface of the door body and including the protrusion accommodating part, and a lower cap decode defining a lower surface of the door body, and the panel bracket may include an upper bracket provided on an upper end of a rear surface of the panel and including the mounting protrusion, and a lower bracket provided on a lower end of a rear surface of the panel and supported by a lower end of the lower cap deco.

A restraining protrusion protruding upward may be formed on the lower cap deco, a lower mounting protrusion that has an open lower surface and into which the restraining protrusion is inserted may be formed on the lower bracket, and the mounting protrusion may be inserted into the protrusion accommodating part to restrain upper and lower ends of the door panel in a state in which the restraining protrusion is inserted into the lower mounting protrusion.

The panel may be formed in a metal plate and may include a bending part bent rearward on a perimeter of the panel, and a bending part accommodating groove into which the bending part is inserted may be formed on a front surface of the panel bracket when the panel bracket is coupled to a rear surface of the panel.

The panel may be formed of a plate-shaped material, plastic, ceramic, and a composite material.

DETAILED DESCRIPTION

Hereinafter, detailed embodiments will be described in detail with reference to the accompanying drawings. However, the present disclosure is limited to the embodiments in which the spirit of the present disclosure is proposed, and other degenerate idea or other embodiments included in the scope of the present disclosure may be easily proposed by addition, changes, deletions, etc. of other elements.

Prior to a description, directions are defined. In an embodiment of the present disclosure, a front surface of a door, that is, a direction in which a door panel is directed shown in FIG. 1 is defined as a front direction, a rear surface of the door, that is, a direction in which a door liner is directed is defined as a rearward direction, a direction toward a bottom on which a refrigerator is mounted is defined as a downward direction, and a direction away from the bottom is defined as an upward direction.

Figure 1:
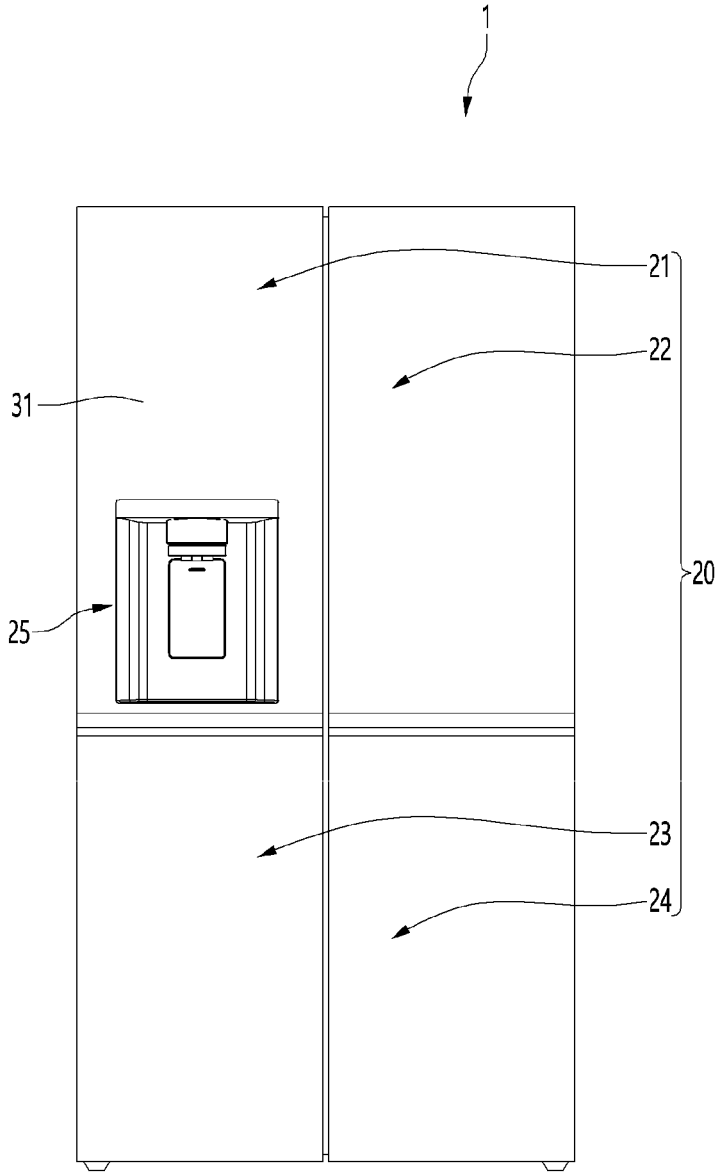
FIG. 1 is a perspective view of a refrigerator according to an embodiment of the present disclosure.

FIG. 1 is a perspective view of a refrigerator according to an embodiment of the present disclosure.

As shown in the drawing, a refrigerator 1 according to an embodiment of the present disclosure may include a cabinet that defines a storage space, and a refrigerator door 20 (hereinafter referred to as the door 20) that is disposed in front of the cabinet and opens and closes the storage space.

The storage space may have an open front surface, and may be divided into a plurality of spaces as necessary. For example, the storage space of the refrigerator 1 may be partitioned up and down, and may have a refrigerating compartment at an upper portion and a freezing chamber at a lower portion.

The door 20 may include refrigerating compartment doors 21 and 22 and freezing compartment doors 23 and 24, for opening and closing the refrigerating compartment and the freezing compartment. The refrigerating compartment doors 21 and may be disposed at an upper side, and a pair of the refrigerating compartment doors 21 and 22 may be provided on both right and left sides to open and close the refrigerating compartment via rotation. The freezing compartment doors 23 and 24 may be disposed below the refrigerating compartment doors 21 and 22, and a pair of the freezing compartment doors 23 and 24 may be provided to open and close the freezing compartment via rotation.

According to an embodiment of the present disclosure, for convenience of description and understanding, although the refrigerator having a pair of the doors 20 at an upper front side and a pair of the doors 20 at a lower front side of the cabinet is exemplified, the present disclosure is not limited thereto, and is applicable to all types of refrigerators including a door.

Hereinafter, for convenience of description, any one of the refrigerating compartment doors 21 will be exemplified, and the refrigerating compartment door 21 will be referred to as the door 20.

The door 20 may define a front appearance of the refrigerator 1 by a panel 31 defining a front surface in a closed state. The door 20 may further include a dispenser 25 for taking out water or ice from the outside as necessary.

Needless to say, the door 20 according to an embodiment of the present disclosure may not include the dispenser 25, and in this case, an entire front surface of a door panel 30 may be defined by the panel 31.

Hereinafter, the structure of the door 20 will be described in more detail with reference to the drawings.

Figure 2:
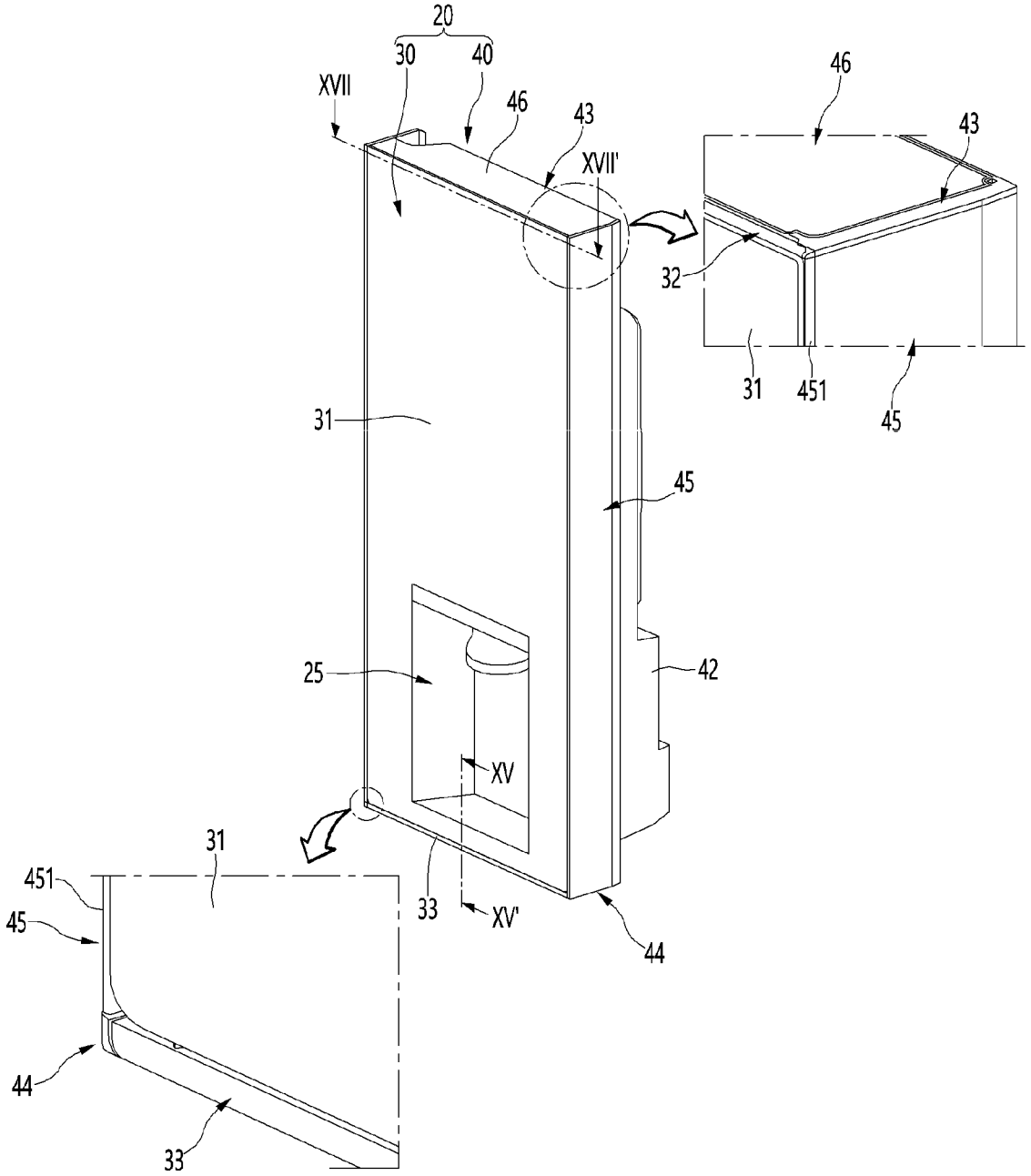
FIG. 2 is a perspective view of a refrigerator door according to an embodiment of the present disclosure.
Figure 3:
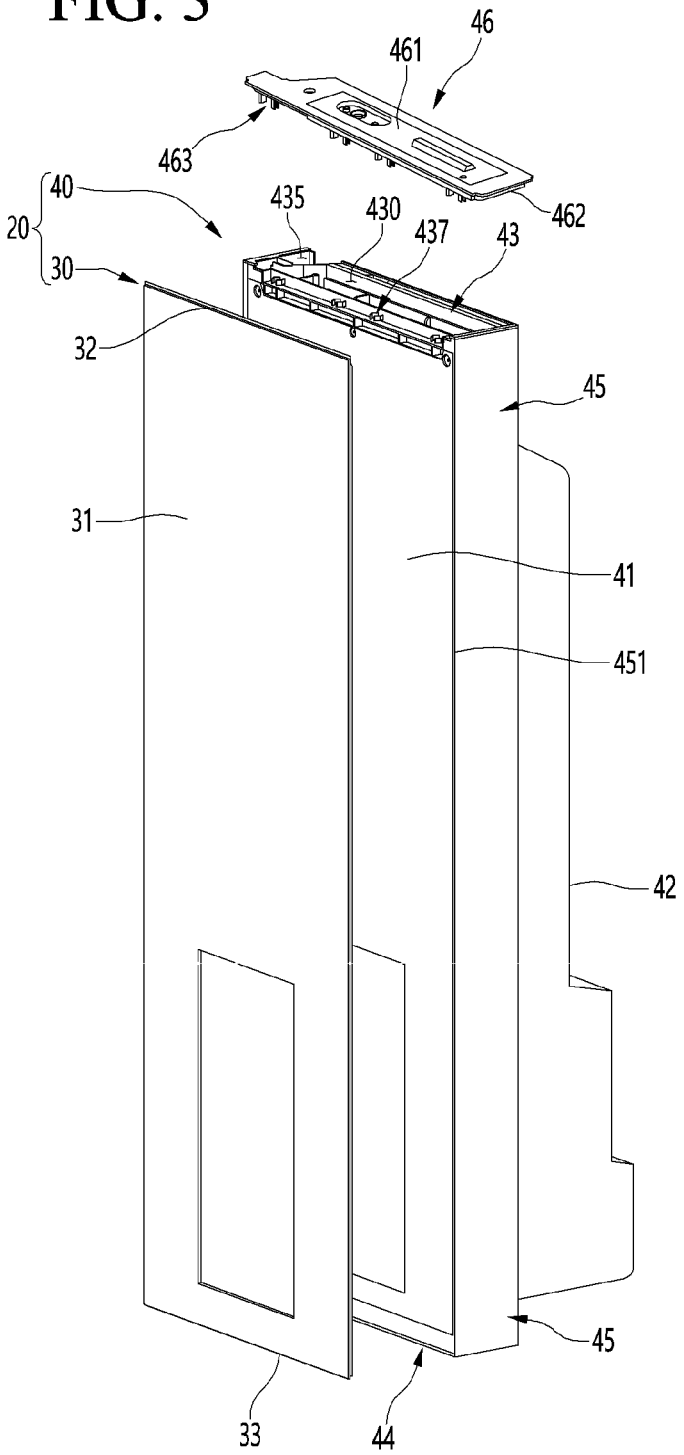
FIG. 3 is an exploded perspective view of the refrigerator door.

FIG. 2 is a perspective view of a refrigerator door according to an embodiment of the present disclosure. FIG. 3 is an exploded perspective view of the refrigerator door.

As shown in the drawings, the door 20 may include a door body 40 for opening and closing the storage space, and the door panel 30 that is coupled to the door body 40 and defines the front appearance of the door 20.

The door body 40 may define the overall shape of the door 20, and may substantially open and close and insulate the storage space. The door body 40 may be formed by coupling a body cover 41 defining a front surface, a door liner 42 defining a rear surface, an upper cap deco 43 defining an upper surface, a lower cap deco 44 defining a lower surface, and a side deco 45 defining right and left side surfaces.

The body cover 41 may define a front shape of the door body 40. The body cover 41 may be formed in a metal plate shape, and may be formed of an iron plate material to which a magnet 35 is capable of being attached. A plurality of screws 412 may be fastened around the body cover 41 to fixedly couple the body cover 41 to the upper cap deco 43, the lower cap deco 44, and the side deco 45.

The door liner 42 may be formed of a plastic material and may define a rear shape of the door body 40. Although not shown in detail, the door liner 42 may have an ice making chamber connected to the dispenser 25 to make and store ice.

The upper cap deco 43 may be coupled to an upper end of the body cover 41 and may define an upper appearance of the door body 40. The upper cap deco 43 may define an upper end of a front surface of the door body 40 and may have a protrusion accommodating part 437 to which an upper bracket 32 of the door panel 30 is coupled when the door panel 30 is mounted.

A deco opening 346 recessed downward may be formed on an upper surface of the upper cap deco 43. Although not shown, electrical components may be accommodated inside the deco opening 346. For example, the electrical component may include various devices to be accommodated inside the deco opening 346, such as a sensor device for detection of a user, a microphone for detecting voice of the user, a speaker for outputting sound, and a door locking device for automatic opening of the door 20.

The deco opening 346 may be opened toward an upper side of the upper cap deco 43, and an open upper surface of the deco opening 346 may be shielded by a deco cover 46. The deco cover 46 may be mounted on the upper cap deco 43 to shield the deco cover 46, and may be coupled to the upper cap deco 43 to define an upper surface of the door body 40. In addition, a restraining protrusion 463 for restraining the protrusion accommodating part 437 may protrude downwardly from the upper cap deco 43.

A hinge mounting protrusion 435 may be formed at one end of the upper cap deco 43. A hinge device for rotatably mounting the door 20 to a cabinet 10 may be coupled to the hinge mounting protrusion 435.

The structures of the upper cap deco 43 and the deco cover 46 will be described below in more detail.

The lower cap deco 44 may be coupled to lower ends of the body cover 41 and the door liner 42 to form a lower appearance of the door body 40. The lower cap deco 44 may define a lower front end of the door body 40 and may be coupled to a lower bracket 33 of the door panel 30 when the door panel 30 is mounted.

The side deco 45 may connect the body cover 41 to right and left ends of the body cover 41, the door liner 42, the upper cap deco 43, and the lower cap deco 44, and may define an outer appearance of right and left side surfaces of the door body 40. In addition, a side support part 323 protruding forward compared with the body cover 41 may be formed on the side deco 45 to support both right and left ends of the door panel 30 when the door panel 30 is mounted.

The door panel 30 may define a front appearance of the door 20 and, as necessary, may be to be detached from the door body 40. For example, the door panel 30 may be manufactured to have various colors or textures, and may be selectively mounted on the door body 40 according to a user's preference. In addition, the outer appearance of the refrigerator 1 may be changed by replacing the door panel 30.

The door panel 30 may include the panel 31 defining an outer appearance, and a panel bracket provided on a rear surface of the panel 31 to mount the door panel 30 on the door body 40. The panel bracket may include at least one of the upper bracket 32 or the lower bracket 33.

Hereinafter, the structures of the upper bracket 32 and the lower bracket 33 coupled to the door panel 30 and the door panel 30 will be described in more detail with reference to the drawings.

Figure 4:
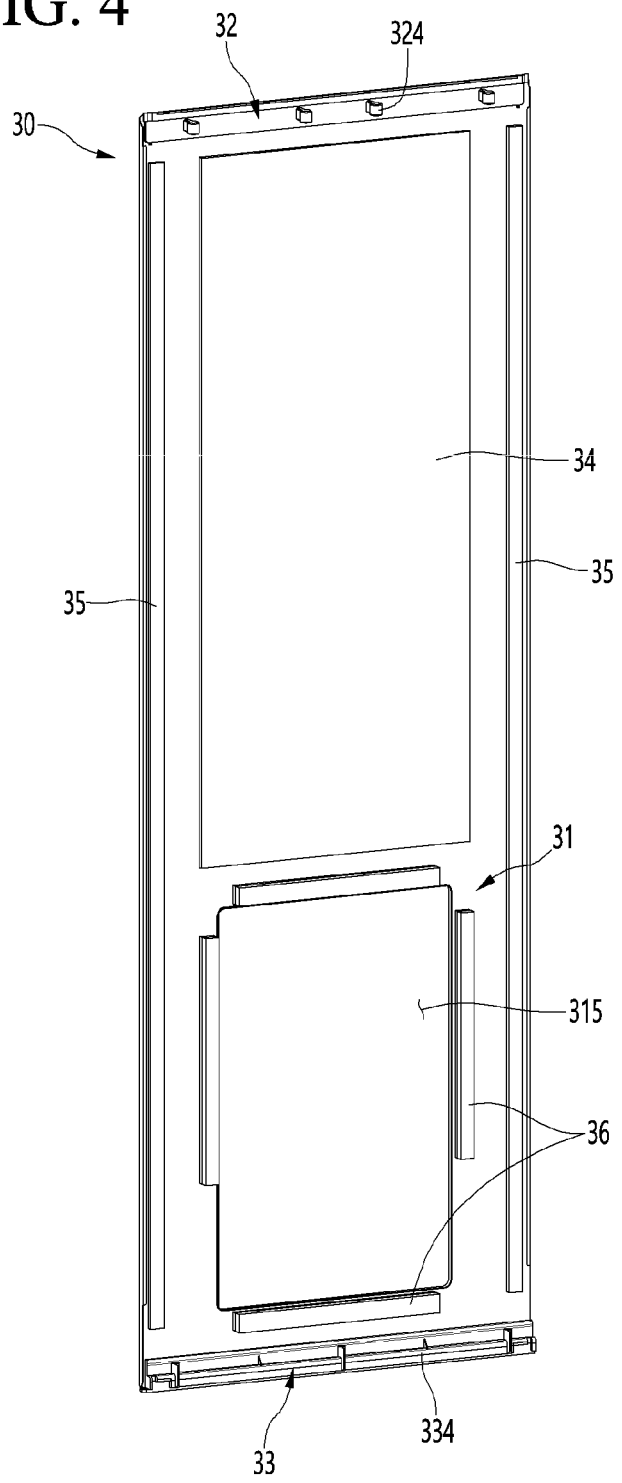
FIG. 4 is a perspective view showing a rear surface of a door panel that is one component of a door.

FIG. 4 is a perspective view showing a rear surface of a door panel that is one component of a door.

As shown in the drawing, the door panel 30 may include the panel 31 and the panel bracket.

The panel 31 may be formed of a plate-shaped material. For example, the panel 31 may be formed of a stainless steel plate material. The panel 31 may be formed of a plate-shaped material and may have a bent perimeter. In detail, the panel 31 may include a panel front part 311 defining a front appearance, and bending parts 312, 313, and 314 bent rearward along a perimeter of the panel front part 311.

The panel front part 311 may be formed in a rectangular shape to form a front surface of the door 20 and may be formed in a planar shape. The bending parts 312, 313, and 314 (refer to FIGS. 5 and 8) may include an upper bending part 312 formed along an upper end of the panel front part 311 and extending rearward perpendicular to the panel front part 311, and a lower bending part 314 formed along a lower end of the panel front part 311 and extending rearward perpendicular to the panel front part 311. The upper bending part 312 and the lower bending part 314 may be fixedly inserted into the upper bracket 32 and the lower bracket 33, respectively.

The bending parts 312, 313, and 314 may further include a side bending part 313 formed along both sides of the panel front part 311. The side bending part 313 may extend rearward perpendicularly to the panel front part 311, and the extending end may be further bent to be round inward again. Accordingly, when the door panel 30 is transported, the upper bending part 312 and the lower bending part 314 may be covered by the upper bracket 32 and the lower bracket 33, and an end of the side bending part 313 may be rounded, and accordingly, it may be possible to prevent safety accidents such as being cut or stabbed by a sharp end of the panel 31.

The upper bracket 32 may be provided on an upper end of the panel 31. The upper bracket 32 may have a length corresponding to a horizontal length of the panel and may be attached to an upper end of a rear surface of the panel 31. An upper end of the upper bracket 32 may protrude compared with the upper end of the panel 31 and may support the upper end of the panel 31 to protect the upper end of the panel 31 and to define an upper appearance of the door panel 30.

A mounting protrusion 324 protruding rearward may be formed on a rear surface of the upper bracket 32. The mounting protrusion 324 may be coupled to the protrusion accommodating part 437 of the upper cap deco 43 to fixedly mount the door panel 30 on the door body 40. As such, the upper bracket 32 may define an upper end of the door panel 30, and simultaneously, may have a function of mounting the door panel 30 on the door body 40. The upper bracket 32 may be referred to as a first bracket.

The lower bracket 33 may be provided to oppose the upper bracket 32.

In detail, the lower bracket 33 may be provided at a lower end of the panel 31. The lower bracket 33 may have a length corresponding to a horizontal length of the panel 31 and may be attached to a lower end of the rear surface of the panel 31. The lower end of the lower bracket 33 may protrude compared with the lower end of the panel 31 and may support the lower end of the panel 31 to protect the lower end of the panel 31 and to define a lower appearance of the door panel 30.

A lower mounting protrusion 334 protruding rearward may be formed on a rear surface of the lower bracket 33. The lower mounting protrusion 334 may be coupled to the lower cap deco 44 and may fixedly mount the door panel 30 on the door body 40. As such, the lower bracket 33 may define a lower end of the door panel 30, and simultaneously, may have a function of mounting the door panel 30 on the door body 40. The lower bracket 33 may be referred to as a second bracket to be distinguished from the first bracket.

The door panel 30 may further include a buffer member 34. The buffer member 34 may be attached to the rear surface of the panel 31 and may fill a space between the panel 31 and the body cover 41 when the door panel 30 is mounted on the door body 40. Thus, even if an impact or pressure is applied to a front surface of the door panel 30, it may be possible to prevent the door panel 30 from being deformed or damaged. The buffer member 34 may be formed of an elastic material such as sponge, foam PU, or foam PE.

The door panel 30 may further include the magnet 35. The magnet 35 may be attached to the rear surface of the panel 31. When the door panel 30 is mounted on the door body 40, the magnet 35 may be attached to the body cover 41 via magnetic force. Thus, the door panel 30 may maintain a state of being temporarily fixed to the door body 40 by the magnet 35. The door panel 30 may maintain a more firmly mounted state to the door body 40 by the magnet 35. The magnet 35 may be vertically elongated and may be disposed between the upper bracket 32 and the lower bracket 33. In addition, the magnet 35 may be disposed on both right and left sides of the buffer member 34.

A dispenser opening 316 may be formed in a portion of the panel front part 311, which corresponds to a position of the dispenser 25. The dispenser opening 316 may be formed to correspond to a shape of the dispenser 25 and may be coupled to a perimeter of a dispenser case 251 (refer to FIG. 15) included in the dispenser 25. An adhesive member 36 may be further provided along a perimeter of the dispenser opening 316 to maintain the state in which a perimeter of the dispenser opening 316 is fixedly coupled.

Needless to say, the door 20 may not include the dispenser 25, and may include a display for displaying an operation state of the refrigerator 1. The panel 31 may be formed of glass, plastic, ceramic, composite material, and the like in addition to a metal material, and may be formed in a plate shape defining a front surface of the door 20.

Hereinafter, the structures of the upper bracket 32 and the lower bracket 33 will be described in more detail with reference to the drawings.

Figure 5:
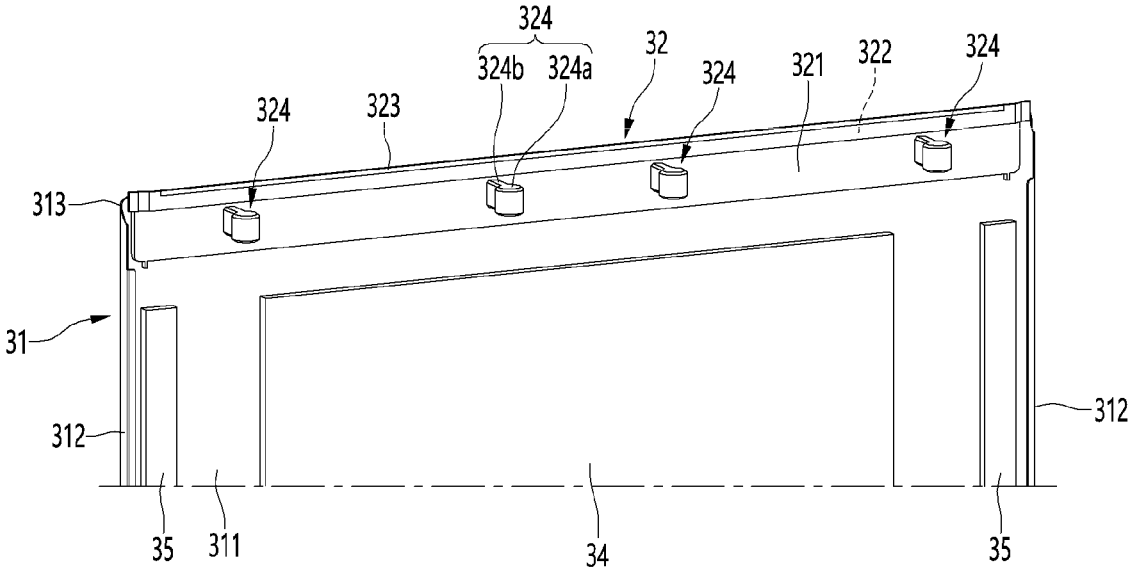
FIG. 5 is an enlarged partial perspective view of an upper part of a rear surface of the door panel.
Figure 6:
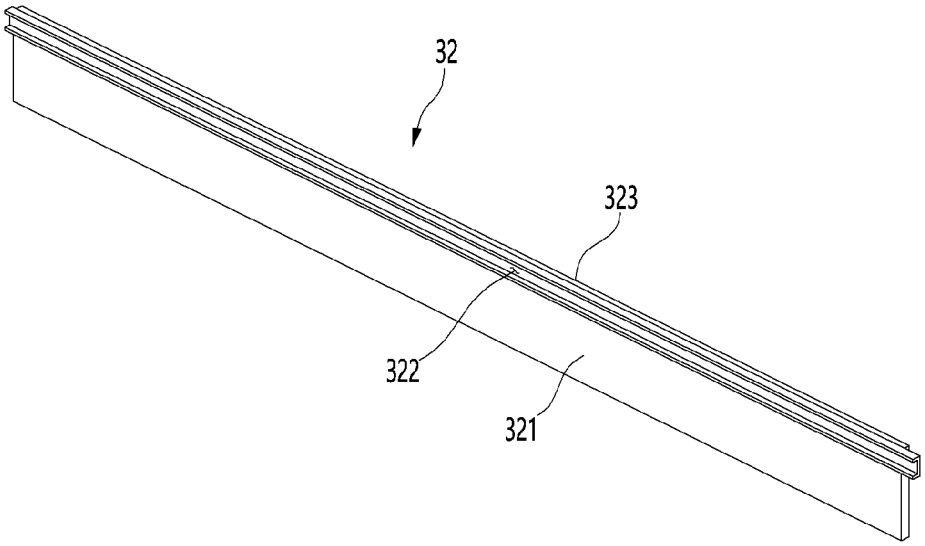
FIG. 6 is a perspective view of an upper bracket, which is a component of the door panel, viewed from the front.
Figure 7:
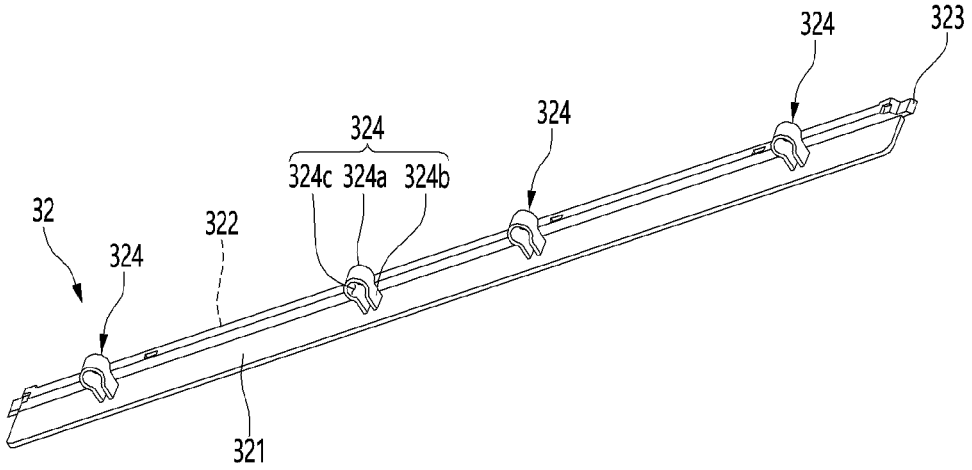
FIG. 7 is a perspective view of the upper bracket viewed from the rear.

FIG. 5 is an enlarged partial perspective view of an upper part of a rear surface of the door panel. FIG. 6 is a perspective view of an upper bracket, which is a component of the door panel, viewed from the front. FIG. 7 is a perspective view of the upper bracket viewed from the rear.

As shown in the drawings, the upper bracket 32 may be coupled to the upper end of the panel 31. The upper bracket 32 may be disposed in front of the upper cap deco 43 and may be mounted on the upper cap deco 43 when the door panel 30 is mounted.

The upper bracket 32 may be formed of a plastic material, and may include a coupler 321 coupled to the rear surface of the panel 31, a support part 323 formed on an upper end of the front surface of the coupler 321, and the mounting protrusion 324 protruding rearward from the rear surface of the coupler 321.

In detail, the coupler 321 may be attached to the rear surface of the panel 31 and may be formed in a plate shape having a predetermined area. A horizontal width of the coupler 321 may be formed to correspond to a horizontal length of the panel 31.

An adhesive may be applied to a front surface of the coupler 321 or a member for bonding such as a double-sided tape may be disposed on the front surface. Accordingly, the coupler 321 may maintain a state of being completely adhered to the rear surface of the panel 31.

An upper accommodating groove 322 may be formed at an upper portion of the coupler 321. The upper accommodating groove 322 may extend from one end of the upper bracket 32 to the other end, and may be recessed to allow the upper bending part 312 of the panel 31 to be inserted thereinto. Accordingly, in the panel 31, the upper bending part 312 may be inserted into the upper accommodating groove 322, and simultaneously, the front surface of the coupler 321 may be bonded to the rear surface of the panel 31. In addition, the upper bracket 32 may be assembled with the upper cap deco 43 in the state of being coupled to the panel 31.

The support part 323 may be formed at the upper end of the upper bracket 32. The support part 323 may be formed above the coupler 321 and may protrude forward from the upper end of the upper accommodating groove 322. Thus, the support part 323 may support the upper end of the upper bending part 312 and may be in contact with the upper end of the panel 31. In this case, the upper bracket 32 may maintain the state in which the upper bending part 312 and the support part 323 are in close contact with each other in the state in which the coupler 321 is adhered to the panel 31, and may prevent an interval between the panel 31 and the support part 323 from being widened when the door panel 30 is viewed from the front.

The support part 323 may protrude to a position corresponding to a front plate of the panel 31, and thus, the support part 323 may define an upper appearance of the door panel 30 while supporting the upper end of the panel 31. The support part 323 may support the upper end of the panel 31 to restrain an upward flow of the panel 31 and to simultaneously protect the upper end of the panel 31 from being damaged by impact.

The support part 323 may be formed to have a thinner thickness as protruding forward, and may be inclined or rounded to minimize exposure of the support part 323 when viewed from the front.

The support part 323 may also protrude rearward, and a rear end of the support part 323 may be in contact with a front end of the deco cover 46. In addition, the support part 323 may form a portion of an upper surface of the door body 40.

The mounting protrusion 324 may protrude rearward from the rear surface of the coupler 321. The mounting protrusion 324 may protrude at a position opposing the protrusion accommodating part 437 of the upper cap deco 43. For example, one of the mounting protrusions 324 may be disposed on both right and left sides of the upper bracket 32, and two may be disposed in a central portion spaced apart from each other, and thus a total of four mounting protrusions 324 may be formed. The mounting protrusion 324 may be formed to be inserted into the protrusion accommodating part 437.

In detail, the mounting protrusion 324 may include an extension 324*b* and an insert part 324*a*. The extension 324*b* may protrude rearward from the coupler 321 and may be formed to have a length and a width for being inserted into an accommodating part opening 437*d* of a front end of the protrusion accommodating part 437. The insert part 324*a* may be formed at a rear end of the extension 324*b* and may be formed to be inserted into the protrusion accommodating part 437.

The insert part 324*a* may have a greater width than the width of the extension 324*b*, and may be formed with a corresponding shape to be in contact with an inner surface of the protrusion accommodating part 437 in the state of being inserted into the protrusion accommodating part 437. The insert part 324*a* may be easily inserted into the protrusion accommodating part 437, and may be formed not to be easily separated by maintaining a restrained state in the inserted state. To this end, the insert part 324*a* may be formed to have a width that is the largest at a central portion and is reduced forward and rearward. A perimeter surface of the insert part 324*a* may be inclined or rounded. For example, the insert part 324*a* may be formed in a circular or oval shape when viewed from above.

The mounting protrusion 324 may have a predetermined height in a vertical direction, and both the insert part 324*a* and the extension 324*b* may have perimeter surfaces of the same height. In addition, the mounting protrusion 324 may have an open lower surface to form a protrusion space 324*c* therein.

It may be possible to lose weight during injection molding of the upper bracket 32 by the protrusion space 324*c*, and the mounting protrusion 324 may be accurately molded to a set size and shape without shrinkage. Thus, the engagement of the mounting protrusion 324 with the protrusion accommodating part 437 may be ensured.

As such, the mounting protrusion 324 may be integrally molded with the upper bracket 32, and may be injection molded from a plastic material.

Figure 8:
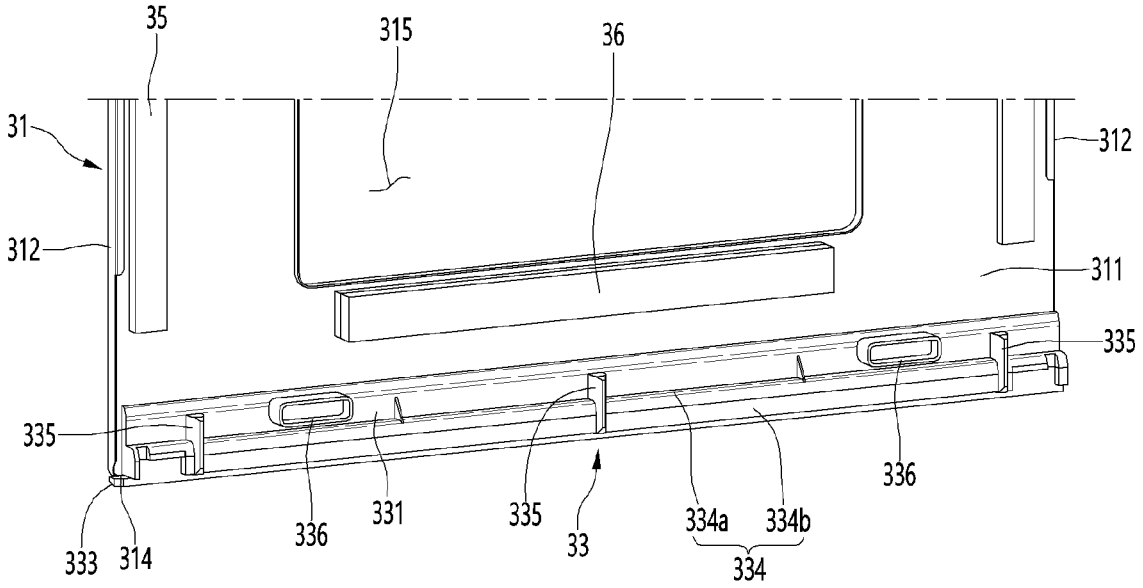
FIG. 8 is an enlarged partial perspective view of a lower part of a rear surface of the door panel.
Figure 9:
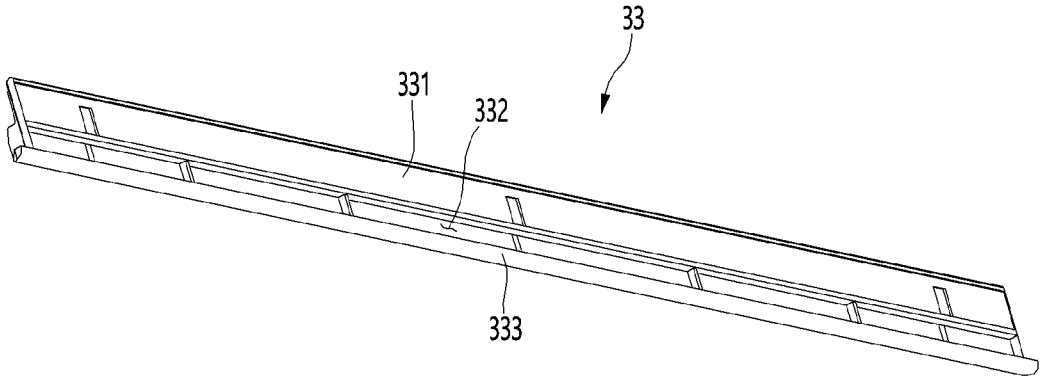
FIG. 9 is a perspective view of a lower bracket, which is a component of the door panel, viewed from the front.
Figure 10:
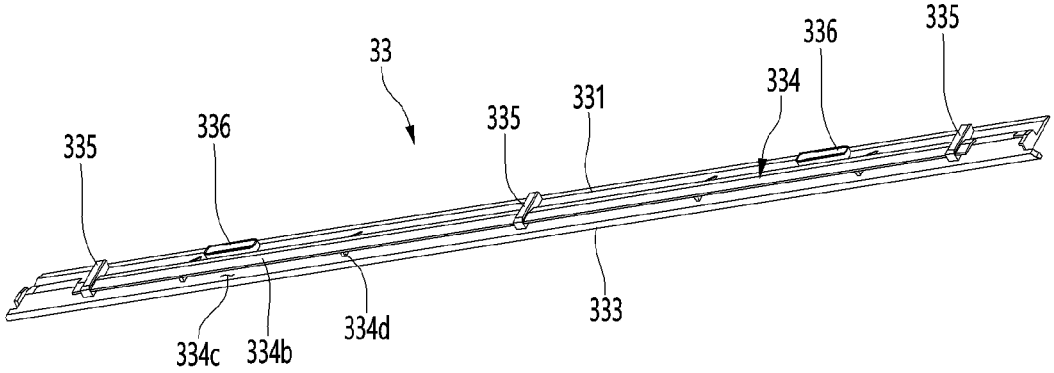
FIG. 10 is a perspective view of the lower bracket viewed from the rear.

FIG. 8 is an enlarged partial perspective view of a lower part of a rear surface of the door panel. FIG. 9 is a perspective view of a lower bracket, which is a component of the door panel, viewed from the front. FIG. 10 is a perspective view of the lower bracket viewed from the rear.

As shown in the drawings, the lower bracket 33 may be formed of a plastic material, and may have a length corresponding to the right and left widths of the panel 31. The lower bracket 33 may be formed to have a width set in a vertical direction.

The lower bracket 33 may be provided at the lower end of the door panel 30 and may be coupled to the lower cap deco 44 to restrain the lower end of the door panel 30. The lower bracket 33 may be coupled to a lower end of the rear surface of the panel 31, and the door panel 30 may be mounted on the lower cap deco 44, and simultaneously, may define a lower appearance of the door panel 30 and to support the lower end of the panel 31.

In detail, the lower bracket 33 may include a lower coupler 331, a lower support part 333, and the lower mounting protrusion 334.

The lower coupler 331 may be formed in a planar shape and may be in contact with the rear surface of the panel 31. The lower coupler 331 may include an adhesive member such as adhesives or a double-sided tape to be mounted in close contact with the rear surface of the panel 31. A pattern or groove structure for facilitating adhesion may be further formed on the lower coupler 331.

A lower accommodating groove 332 may be formed in a lower portion of a front surface of the lower coupler 331. The lower accommodating groove 332 may extend from one end of the lower bracket 33 to the other end, and may be recessed to allow the lower bending part 314 of the panel 31 to be inserted. Accordingly, in the panel 31, the lower bending part 314 may be inserted into the lower accommodating groove 332, and simultaneously, the front surface of the lower coupler 331 may be bonded to the rear surface of the panel 31. The lower bracket 33 may be assembled with the lower cap deco 44 in a state of being coupled to the panel 31.

The lower support part 333 may be formed at a lower end of the lower bracket 33, and may protrude forward from the lower end of the lower accommodating groove 332. Thus, a lower support part 442 may support the lower end of the lower bending part 314 and may be in contact with the lower end of the panel 31. In this case, the lower bracket 33 may maintain the state in which the lower bending part 314 and the lower support part 333 are in close contact with each other in the state in which the lower coupler 331 is adhered to the panel 31, and may prevent an interval between the panel 31 and the lower support part 333 from being widened when the door panel 30 is viewed from the front.

The lower support part 333 may protrude to a position corresponding to the panel front part 311 of the panel 31, and thus the lower support part 333 may define a lower appearance of the door panel 30 while supporting the lower end of the panel 31. The lower support part 333 may support the lower end of the panel 31 to restrain a lower flow of the panel 31 and to simultaneously protect the lower end of the panel 31 from being damaged by impact.

The lower support part 333 may be formed to have a thinner thickness as protruding forward, and may be inclined or rounded to minimize exposure of the lower support part 333 when viewed from the front.

The lower mounting protrusion 334 may also protrude rearward from the rear surface of the lower coupler 331. The lower mounting protrusion 334 may protrude from a position corresponding to a locking protrusion 442*a* formed on the lower cap deco 44, and may have a structure in which the locking protrusion 442*a* is inserted and locked.

The lower mounting protrusion 334 may include a horizontal extension 334*a* and a vertical extension 334*b*. The horizontal extension 334*a* may protrude rearward from an upper side of the lower accommodating groove 332. The vertical extension 334*b* may extend downward from a lower end of the protruding horizontal extension 334*a*. The lower mounting protrusion 334 may have an open lower surface to form a lower mounting protrusion space 334*c* into which the locking protrusion 442*a* is inserted.

The lower mounting protrusion space 334*c* may be opened elongated in a horizontal direction, and all the plurality of the locking protrusions 442*a* may be inserted into the inside of the lower mounting protrusion space 334*c* through the open lower surface of the lower mounting protrusion 334 and may be restrained by the lower mounting protrusion 334. A plurality of reinforcing ribs 334*d* partitioning the lower mounting protrusion space 334*c* may be disposed at regular intervals inside the lower mounting protrusion space 334*c*. Accordingly, the reinforcing rib 334*d* may reinforce the lower mounting protrusion 334 to prevent the lower mounting protrusion 334 from being damaged and to prevent the door panel 30 from being separated from the door body 40.

In addition, an additional reinforcement part 335 extending through the lower mounting protrusion 334 may be further formed on the rear surface of the lower coupler 331. The additional reinforcing part 335 may prevent the lower mounting protrusion 334 from being deformed together with the reinforcing ribs 334*d* and to simultaneously reinforce the strength of the lower bracket 33.

In order to mount the door panel 30, the lower end of the door panel 30, i.e., the lower bracket 33 may be first fixed to the lower cap deco 44, and the upper end of the door panel 30, i.e., the upper bracket 32 may be mounted on the upper cap deco 43. The coupling state of the mounting protrusion 324 and the protrusion accommodating part 437 may be restrained by mounting the deco cover 46, and the door panel 30 may be completely mounted.

The lower support part 442 may be formed on the rear surface of the lower coupler 331. The lower support part 442 may protrude rearward from the rear surface of the lower coupler 331 and may protrude compared with the lower mounting protrusion 334. Thus, when the door panel 30 is mounted, the lower support part 442 may be in contact with a lower front part 441 of the lower cap deco 44 and may support the lower bracket 33 from the rear. The plurality of lower support parts 442 may be formed in a direction in which the lower coupler 331 extends.

Hereinafter, the structures of the door body 40 and the upper cap deco 43 will be described in more detail with reference to the drawings.

Figure 11:
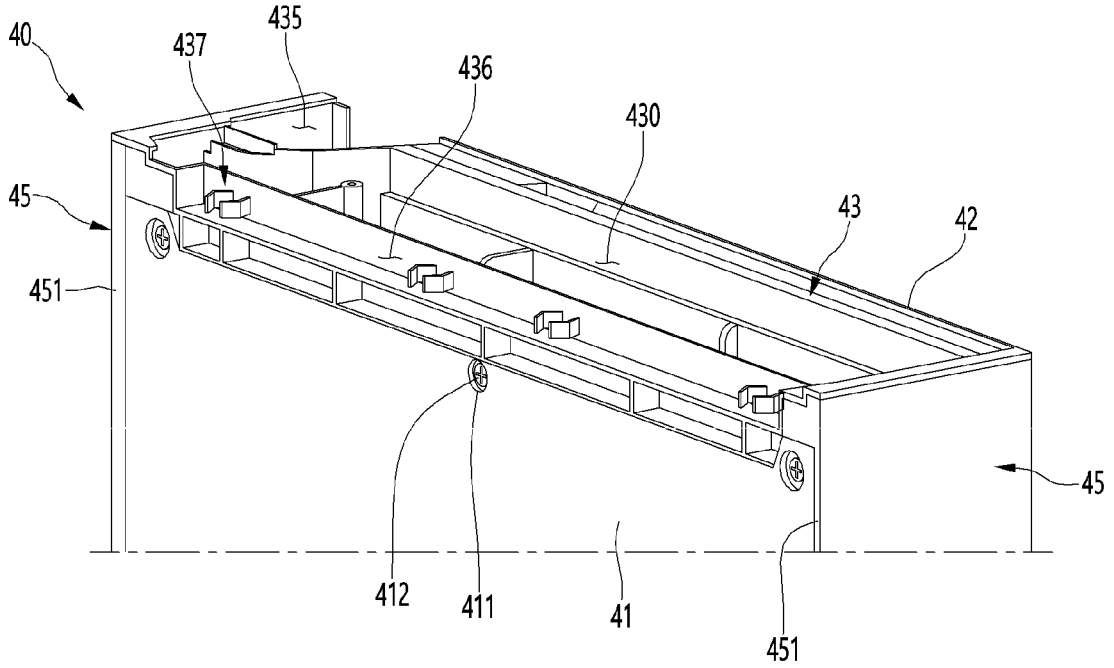
FIG. 11 is a partial perspective view of a door body that is a component of the door.
Figure 12:
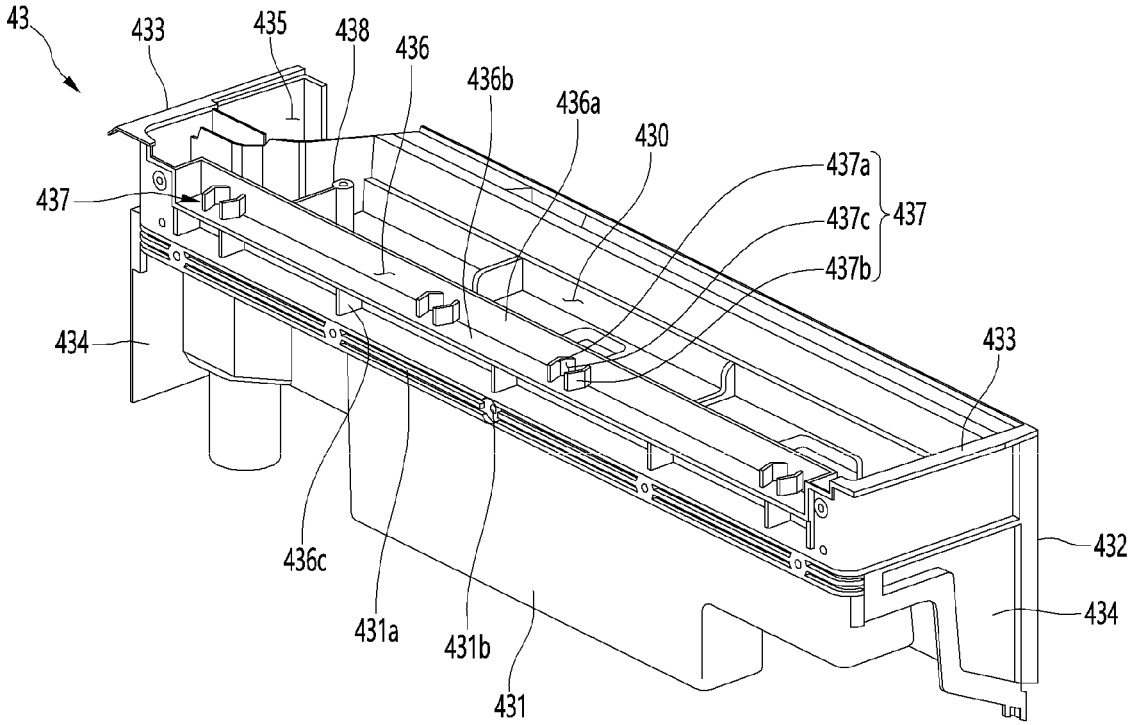
FIG. 12 is a perspective view of an upper cap deco that is a component of the door body.

FIG. 11 is a partial perspective view of a door body that is a component of the door. FIG. 12 is a perspective view of an upper cap deco that is a component of the door body.

As shown in the drawing, the upper cap deco 43 may be mounted on an upper end of the door body 40 to form an upper portion including the upper end of the door body 40. In the state in which the upper cap deco 43 is mounted on the door body 40, rear, front, and upper surfaces of the upper cap deco 43 may be exposed to the outside.

In detail, the upper cap deco 43 may include a front part 431 defining a front surface, a rear part 431 defining a rear surface, an upper part 433 defining an upper surface, and a side part 434 defining right and left side surfaces.

The rear part 431 may be formed in a planar shape by coupling a lower end of rear part 431 to an upper end of the door liner 42. The rear part 431 may be exposed rearward in the state of being mounted on the door body 40 and may form an outer appearance of an upper end of the rear surface of the door body 40.

The lower end of the front part 431 may be coupled to the upper end of the body cover 41. The front part 431 may be exposed forward in the state of being mounted on the door body 40 and may form an outer appearance of the upper end of the front surface of the door body 40.

A cover coupler 431*a* may be formed on the lower end of the front part 431. A deco screw hole 431*b* may be formed in the cover coupler 431*a* and may be formed at a position corresponding to a cover screw hole 411 formed in the body cover 41. The body cover 41 may be coupled to the upper cap deco 43 by the screws 412 coupled to the cover screw hole 411 through the deco screw hole 431*b*.

A deco recess 436 may be formed on the upper end of the front part 431. The deco recess 436 may form a space in which the mounting protrusion 324 is partially accommodated, and the protrusion accommodating part 437 may be formed inside the deco recess 436.

The deco recess 436 may extend from a left end to a right end of the upper end of the front part 431. In addition, the deco recess 436 may have open front and upper surfaces, and may be recessed rearward and downward. Accordingly, the mounting protrusion 324 may be inserted from the front when the door panel 30 is mounted, and the restraining protrusion 463 may be inserted from the top when the deco cover 46 is mounted.

The deco recess 436 may include a recess lower surface 436*b* and a recess rear surface 436*a*. The recess lower surface 436*b* may define a bottom recessed in a downward direction of the deco recess 436, and the recess rear surface 436*a* may define a rear wall recessed rearward.

In this case, a front end of the recess lower surface 436*b* may define a front end of the front part 431, and when the door panel 30 is mounted, the front end of the recess lower surface 436*b* may be in contact with a rear surface of the coupler 321 of the upper bracket 32. Thus, in the state in which the door panel 30 is mounted, the upper bracket 32 may be supported from the rear, and even if force is applied to an upper end of a front surface of the door panel 30 or the upper end of the front surface of the door panel 30 is pressed, the door panel 30 may be prevented from being deformed.

The recess lower surface 436*b* may be spaced apart from an upper side of the cover coupler 321. A plurality of lower support parts 436*c* may be formed between the recess lower surface 436*b* and the upper end of the cover coupler 321. The lower support part 436*c* may be formed in a rib shape that perpendicularly intersects the recess lower surface 436*b*, and may connect the recess lower surface 436*b* and the cover coupler 321 to support the lower support part 436*c* from the below to prevent the lower support part 436*c* from being deformed. The plurality of lower support parts 436*c* may be arranged at regular intervals.

Thus, the present disclosure may provide a structure for preventing the recess lower surface 436*b* from being deformed and for stably supporting and coupling the upper bracket 32 even if a load is applied to the recess lower surface 436*b* by mounting the door panel 30.

The protrusion accommodating part 437 may be formed inside the deco recess 436. The protrusion accommodating parts 437 may be formed at positions to oppose the mounting protrusions 324, and may be formed to correspond to the number of the mounting protrusions 324 to be coupled to the mounting protrusions 324, respectively.

The protrusion accommodating part 437 may be formed in the deco recess 436 and may include a pair of accommodating extensions 437*a* and 437*b* that are spaced apart from each other. The protrusion accommodating part 437 may be formed in a plate shape having a predetermined thickness, and may be configured in such a way that the mounting protrusion 324 is inserted between the pair of accommodating extensions 437*a* and 437*b*.

In detail, the accommodating extensions 437*a* and 437*b* may protrude forward from the recess rear surface 436*a*. The lower end of the accommodating extensions 437*a* and 437*b* may be spaced apart from the recess lower surface 436*b*. Thus, the accommodating extensions 437*a* and 437*b* extending forward may be elastically deformed in right and left directions by inserting the mounting protrusion 324.

The front ends of the pair of accommodating extensions 437*a* and 437*b* may be spaced apart from each other to form the accommodating part opening 437*d*. The accommodating part opening 437*d* may be an entrance into which the mounting protrusion 324 is inserted. The pair of accommodating extensions 437*a* and 437*b* may have an interval that is the largest at a central portion and is reduced forward and rearward. The accommodating extensions 437*a* and 437*b* may be formed in a shape corresponding to a shape of an outer shape of the insert part 324*a* to surround an outer surface of the insert part 324*a* of the mounting protrusion 324. That is, the accommodating extensions 437*a* and 437*b* may be formed to be round in a shape corresponding to the outer surface of the insert part 324*a*.

Accordingly, when the door panel 30 is mounted, the mounting protrusion 324 may be press-fitted into a space between the pair of accommodating extensions 437*a* and 437*b*, in a process of inserting the mounting protrusion 324, the accommodating extensions 437*a* and 437*b* may be elastically deformed, and after the mounting protrusion 324 is completely inserted, the accommodating extensions 437*a* and 437*b* may surround the outer surface of the insert part 324*a* to restrain the mounting protrusion 324 from being easily separated from the inside of the protrusion accommodating part 437.

Needless to say, lower ends of the accommodating extensions 437*a* and 437*b* may be molded in the state of being coupled to the recess lower surface 436*b*, and in this case, the protrusion accommodating part 437 may not be elastically deformed. However, since the protrusion accommodating part 437 has a structure open upward, a restraining protrusion may be inserted into the lower mounting protrusion space 334*c* through a single process of moving the door panel 30 downward from an upper side rather than rotating the door panel 30, and the mounting protrusion 324 may be inserted into the inside of the protrusion accommodating part 437 and may simultaneously fix the upper and lower ends of the door panel 30.

The upper part 433 of the upper cap deco 43 may connect the rear part 431 and the upper end of the front part 431 and may form an upper surface of the door body 40. A deco opening 430 recessed downward may be formed in the upper part 433. The deco opening 430 may define a space with an open upper surface, and may provide a space in which an electrical component such as a sensor or a PCB is accommodated when the electrical component is disposed in the door 20.

The deco opening 430 may be shielded by the deco cover 46. The deco cover 46 may be formed in a corresponding shape to shield the deco opening 430. The deco cover 46 may be detachably mounted on the deco opening 430 to easily couple and decouple the upper bracket 32 and the upper cap deco 43.

A hinge mounting protrusion 437 recessed downward may be formed at one side of the upper part 433. The hinge mounting protrusion 437 may be a part on which a hinge device as a rotation axis of the door 20 is mounted and may be formed at one side of right and left sides.

A side part of the upper cap deco 43 may be formed on right and left side surfaces of the upper cap deco 43. The side part 434 may be shielded by the side deco 45, and a perimeter of the side part 434 may be in close contact with a perimeter of the side deco 45.

Hereinafter, the structure of the deco cover 46 will be described in more detail with reference to the drawings.

Figure 13:
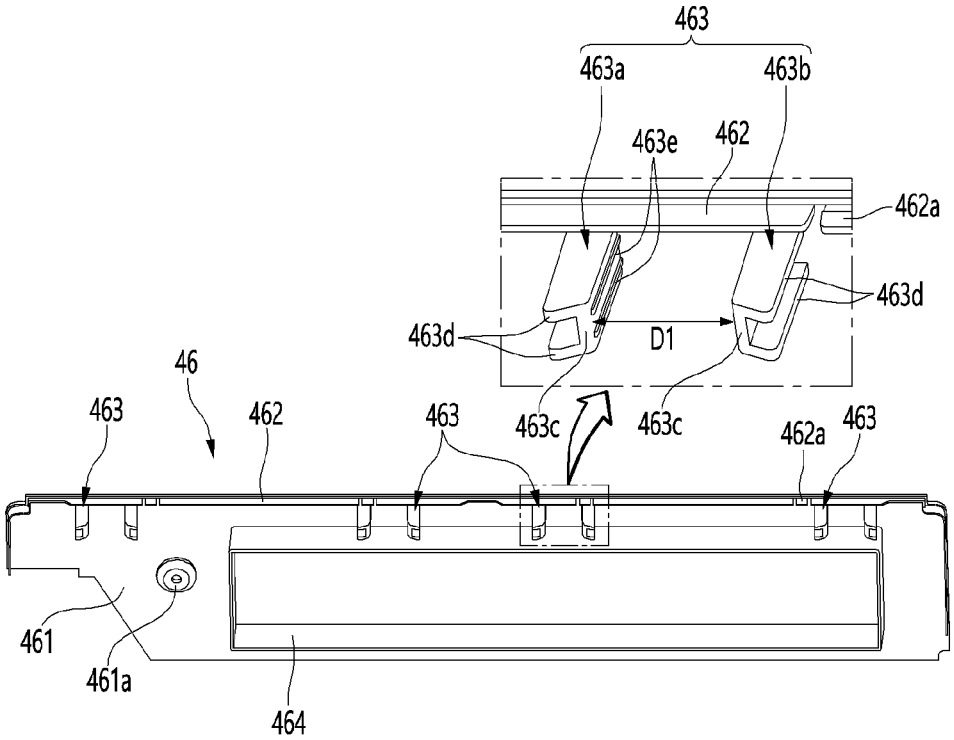
FIG. 13 is a perspective view of a deco cover that is a component of the door body.

FIG. 13 is a perspective view of a deco cover that is a component of the door body.

As shown in the drawing, the deco cover 46 may be mounted on the upper cap deco 43 to shield the deco opening 346 and may define at least a portion of an upper appearance of the door body 40.

As shown in FIG. 8, in the state in which the deco cover 46 is mounted, an upper surface of the door body 40 may be formed by the upper part 433 of the upper cap deco 43, a cover upper surface 461 of the deco cover 46, and the support part 323 of the upper bracket 32.

The deco cover 46 may include the cover upper surface 461 for shielding the deco opening 346, and a cover edge 462 extending downward along a perimeter of the cover upper surface 461. A hook 462*a* may be formed on the cover edge 462 and may be caught and restrained inside the deco opening 430 to maintain the state in which the deco cover 46 is mounted.

The restraining protrusion 463 for restraining the protrusion accommodating part 437 may be formed on the lower surface of the deco cover 46. The restraining protrusion 463 may be formed vertically above the plurality of the protrusion accommodating part 437, and may be formed in a number corresponding to the number of the protrusion accommodating parts 437. Accordingly, when the deco cover 46 is mounted, the restraining protrusions 463 may be respectively coupled to the corresponding protrusion accommodating part 437 to restrain the protrusion accommodating parts 437.

In detail, the restraining protrusion 463 may include a pair of restraining members 463*a* and 463*b* spaced apart from each other, and the restraining members 463*a* and 463*b* may extend downward from the cover upper surface 461. That is, the restraining members 463*a* and 463*b* may extend in a direction crossing the accommodating extensions 437*a* and 437*b*, and the pair of the restraining members 463*a* and 463*b* may extend to be in contact with outer surfaces of the pair of accommodating extensions 437*a* and 437*b*.

In this case, a length by which the restraining members 463*a* and 463*b* extend may be a length by which the restraining members 463*a* and 463*b* cross at least a portion of the accommodating extensions 437*a* and 437*b* when the deco cover 46 is mounted. In the state in which the deco cover 46 is mounted, the accommodating extensions 437*a* and 437*b* and the mounting protrusion 324 may be disposed between the pair of restraining members 463*a* and 463*b*, and the state in which the mounting protrusion 324 is inserted into the inside of the accommodating extensions 437*a* and 437*b* may be maintained.

The pair of restraining members 463*a* and 463*b* may be disposed to face each other, and may be formed in a shape that is symmetrical to each other based on a portion between the restraining members 463*a* and 463*b*. That is, the restraining members 463*a* and 463*b* may include a contact part 463*c* extending downward from an upper surface of the cover, and a side part 463*d* extending in a direction crossing the contact portion 463*c* at both ends of the contact portion 463*c*.

The contact part 463*c* may be formed to face the outer surfaces of the accommodating extensions 437*a* and 437*b*, and the contact parts 463*c* of the restraining members 463*a* and 463*b* disposed on the right and left sides may be disposed in parallel to each other. In this case, a distance D1 between the restraining members spaced apart from each other may correspond to a horizontal width D4 of the most protruding portion of the accommodating extensions 437*a* and 437*b*. In this case, the horizontal width D4 of the accommodating extensions 437*a* and 437*b* may be a horizontal width in the state in which the mounting protrusion 324 is accommodated inside.

A contact rib 463*e* may be formed on the contact part 463*c*. The contact rib 463*e* may extend vertically along the contact part 463*c*. The plurality of contact ribs 463*e* may be formed in parallel to each other. For example, a pair of contact ribs 463*e* may be formed and may extend in a vertical direction at positions spaced apart from each other on both sides based on the center of the contact part 463*c*.

Accordingly, in the state in which the deco cover 46 is mounted and the restraining protrusion 463 is in contact with the protrusion accommodating part 437, the most protruding portion of the outer surface of the accommodating extensions 437*a* and 437*b* may be positioned in a region between the contact ribs 463*e*. The pair of contact ribs 463*e* may be in contact with the outer surfaces of the accommodating extensions 437*a* and 437*b*, respectively.

The contact rib 463*e* may extend upward from the lower end of the contact part 463*c*. The contact rib 463*e* may have a lower protrusion height as extending upward from the lower end. That is, the contact rib 463*e* may have the most protruding lower end and may press the outer surfaces of the accommodating extensions 437*a* and 437*b* during an initial contact and insertion process with the accommodating extensions 437*a* and 437*b*. In the state in which the deco cover 46 is completely mounted, the most protruding lower end of the contact rib 463*e* may also support the lower end of the accommodating extensions 437*a* and 437*b* to prevent the restraining protrusion 463 and the protrusion accommodating part 437 from being randomly separated from each other.

The side part 463*d* may extend in a direction away from the accommodating extensions 437*a* and 437*b* from an end of the contact part 463*c*. The side part 463*d* may support the contact part 463*c* from the outside and may support the contact part 463*c* to prevent the contact part 463*c* from being deformed or damaged. The side part 463*d* may extend along both ends of the contact part 463*c* from the upper surface 461 of the cover, and may extend to the extending lower end of the contact part 463*c*. The lower end of the side part 463*d* may be inclined, and thus when the restraining members 463*a* and 463*b* are in contact with the accommodating extensions 437*a* and 437*b*, the restraining members 463*a* and 463*b* may face the outside of the accommodating extensions 463*a* and 463*b*, and the accommodating extensions 437*a* and 437*b* may be guided toward the contact part 463*c*.

A partition wall 464 inserted into the inside of the deco opening 346 may be extend downward on the cover upper surface 461. The partition wall 464 may define a space in which the electrical component is to be accommodated. The partition wall 464 may be formed in contact with a perimeter surface of the deco opening 346 and may extend downward. For example, the partition wall 464 may be formed in a rectangular shape when viewed from below.

A deco cover screw hole 461*a* may be formed in the cover upper surface 461. The deco cover screw hole 461*a* may be a hole to which a screw for firmly fixing the deco cover 46 is coupled, and a screw passing through the deco cover screw hole 461*a* may be coupled to a deco boss 438 formed inside the deco opening 346 to more firmly fix and mount the deco cover 46 on the upper cap deco 43. Retention of restraints of the door panel 30 may be ensured by ensuring firm fixed mounting of the deco cover 46.

Hereinafter, a mounting structure of the door panel 30 will be described below with reference to the drawings.

Figure 14:
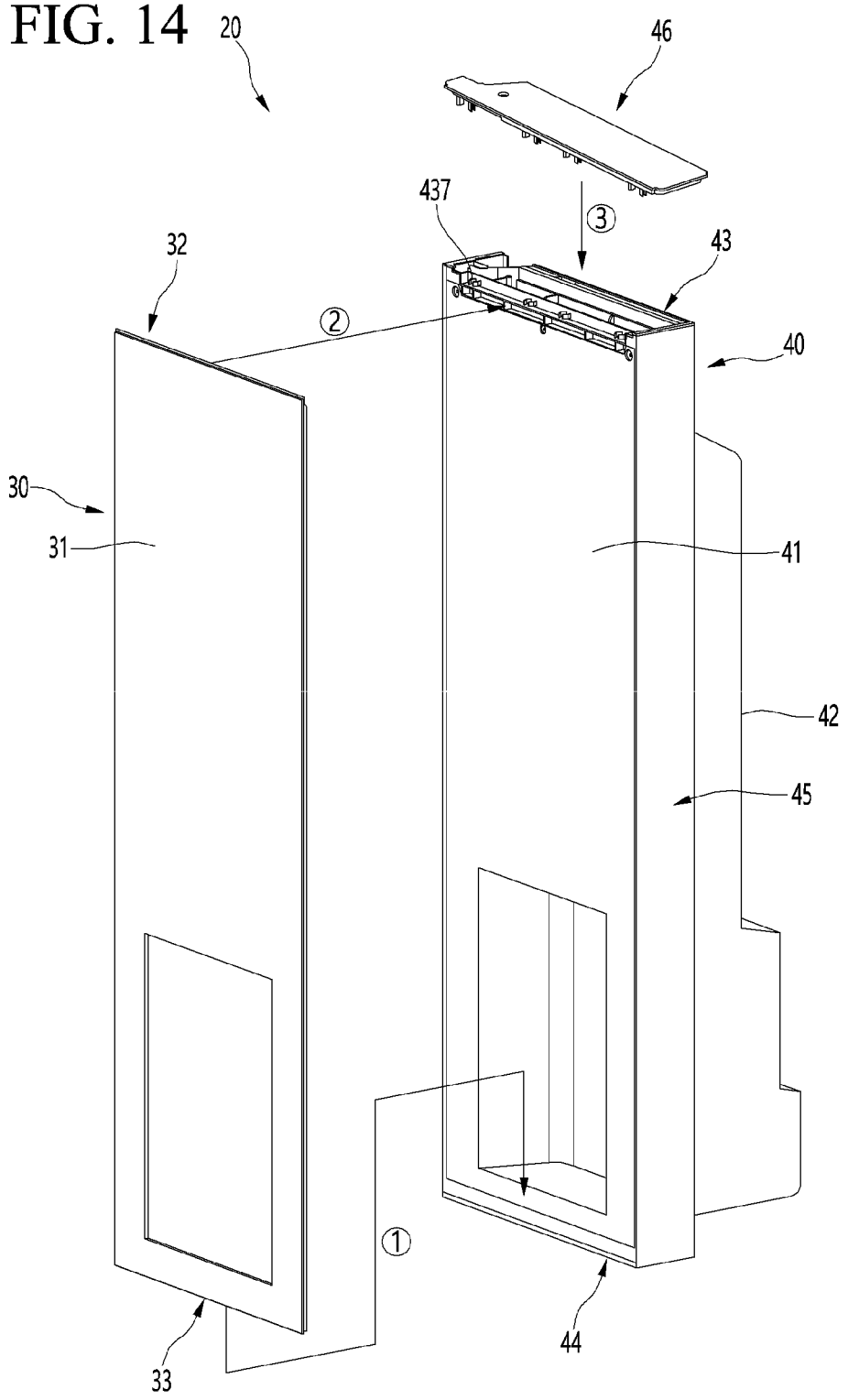
FIG. 14 is a diagram showing an order in which the door panel is mounted.
Figure 15:
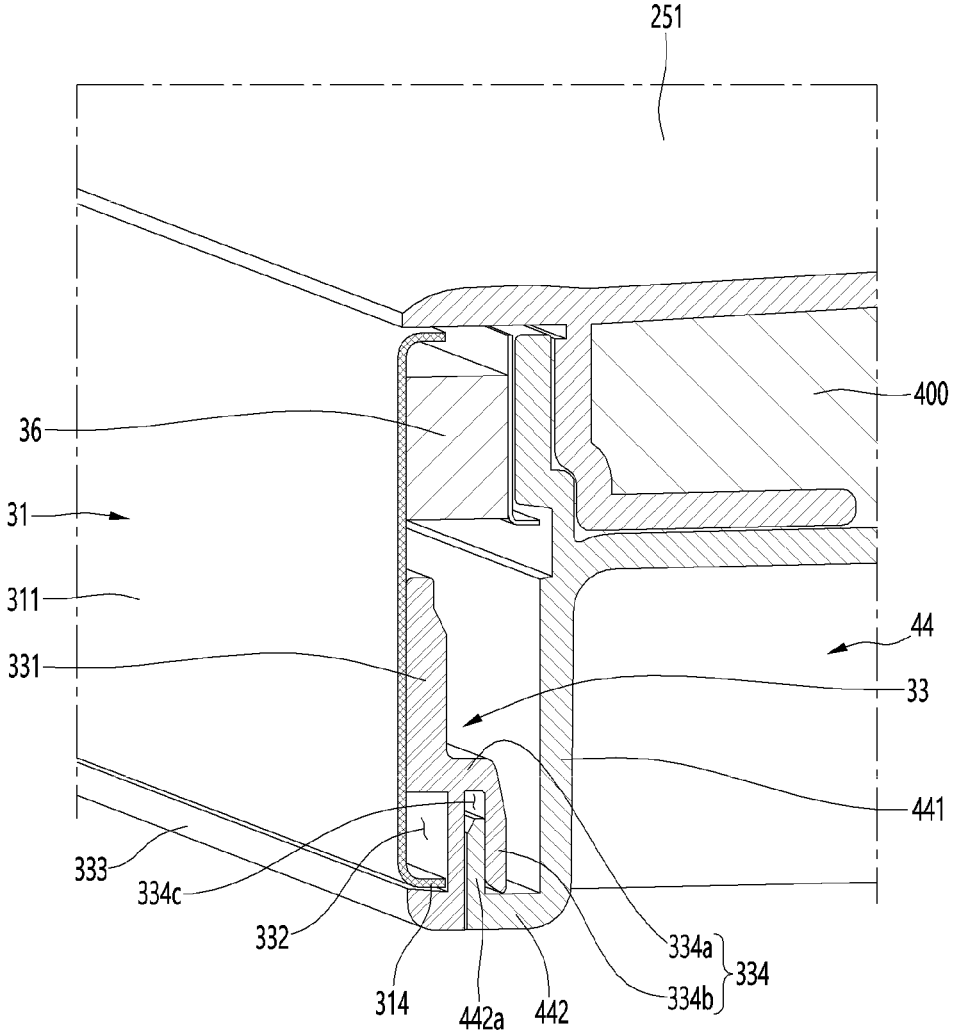
FIG. 15 is a perspective view taken along XV-XV' of FIG. 2.

FIG. 14 is a diagram showing an order in which the door panel is mounted. FIG. 15 is a perspective view taken along XV-XV' of FIG. 2.

As shown in the drawings, the door panel 30 may be prepared in the state in which the upper bracket 32 and the lower bracket 33 are attached to the panel 31.

In this case, the upper bending part 312 and the lower bending part 314 of the panel 31 may be inserted into the inside of the upper accommodating groove 322 and the lower accommodating groove 332. Thus, during transport and assembly, sharp bending parts 312 and 314 of the panel 31 may not be exposed, and the door panel 30 may be simply mounted on the door body 40.

In the state of being attached to the panel 31, the upper bracket 32 and the lower bracket 33 may support ends of the panel 31, i.e., the bending parts 312 and 314, respectively. Thus, in the state in which the door panel 30 is mounted on the door body 40, the upper and lower ends of the panel 31 may be maintained in the state of being in close contact with the support part 323 and the lower support part 333, thereby preventing an interval therebetween from being formed.

In order to mount the door panel 30, the door panel 30 may be brought to the front surface of the door body 40. In this case, the door panel 30 may be mounted by disposing right and left ends of the panel 31 between the side deco 45.

In this case, in the state in which the lower end of the door panel 30, that is, the lower bracket 33 is caught and restrained by the lower cap deco 44, the upper end of the door panel 30, that is, the upper bracket 32 may be coupled, and lastly the door panel 30 may be completely restrained while the deco cover 46 is mounted.

First, a coupling structure of the lower end of the door panel is now described in more detail with reference to FIG. 15, and the lower cap deco 44 may be provided at the lower end of the door body 40 and may define a lower appearance of the door 20 and the door body 40.

In the state in which the lower cap deco 44 is mounted on the door body 40, the lower front part 441 may be exposed to form a lower front end of the door body 40.

The lower support part 442 protruding downward may be formed on a lower surface of the lower cap deco 44. The lower support part 442 may protrude forward from the lower end of the lower front part 441 and may protrude by a height corresponding to a side support part 451. Both ends of the lower support part 442 may be in contact with the lower end of the side support part 451 and may have a height corresponding to a front surface of the panel 31.

The lower support part 442 may support the door panel 30 from the below. The locking protrusion 442*a* protruding upward may be formed on the lower support part 442. The plurality of locking protrusions 442*a* may be formed and may protrude at regular intervals along the lower support part 442. The locking protrusion 442*a* may be spaced apart from the lower front part 441.

When the door panel 30 is mounted, the locking protrusion 442*a* may be inserted into and mounted on the lower end of the door panel 30, that is, the lower mounting protrusion 334 of the lower bracket 33. The locking protrusion 442*a* may be inserted into the inside of the lower mounting protrusion space 334*c* to support the lower bracket 33. Thus, the lower end of the door panel 30 may be fixedly mounted on the lower end of the lower cap deco 44.

In this case, a lower support protrusion 336 of the lower bracket 33 may be in contact with the lower front part 441 of the lower cap deco 44, and thus even if load or compressive force is applied to the lower front end of the door panel 30, the door panel 30 may not be deformed or damaged.

In the state in which the lower end of the door panel 30 is fixedly mounted on the lower cap deco 44 by moving the door panel 30 downward from an upper side, the upper end of the door panel 30 may be fixed to the upper cap deco 43 by rotating the upper end of the door panel 30 using the lower end of the door panel 30 as an axis.

Figure 16:
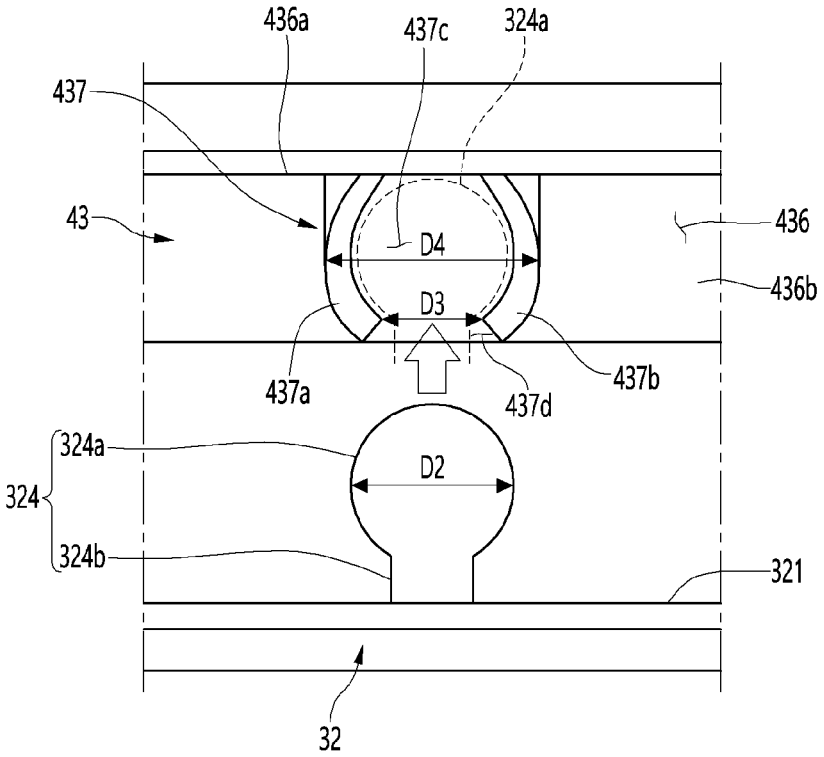
FIG. 16 is a diagram showing a coupling structure of a mounting protrusion of an upper bracket and a protrusion accommodating part of an upper cap deco.
Figure 17:
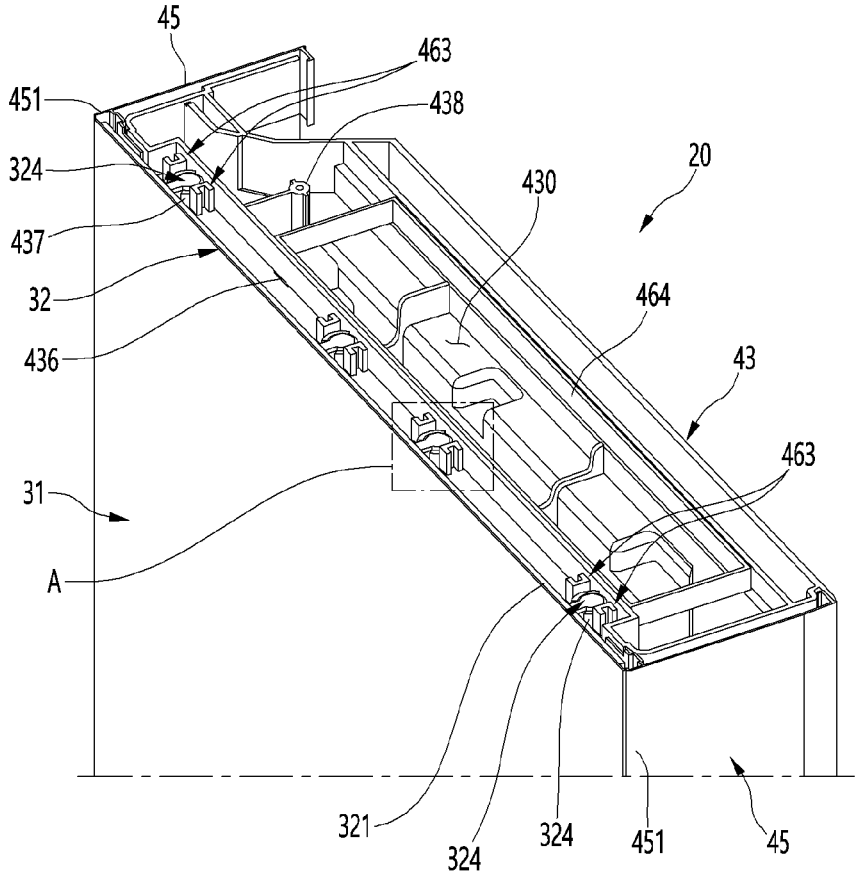
FIG. 17 is a perspective view taken along XVII-XVII' of FIG. 2.
Figure 18:
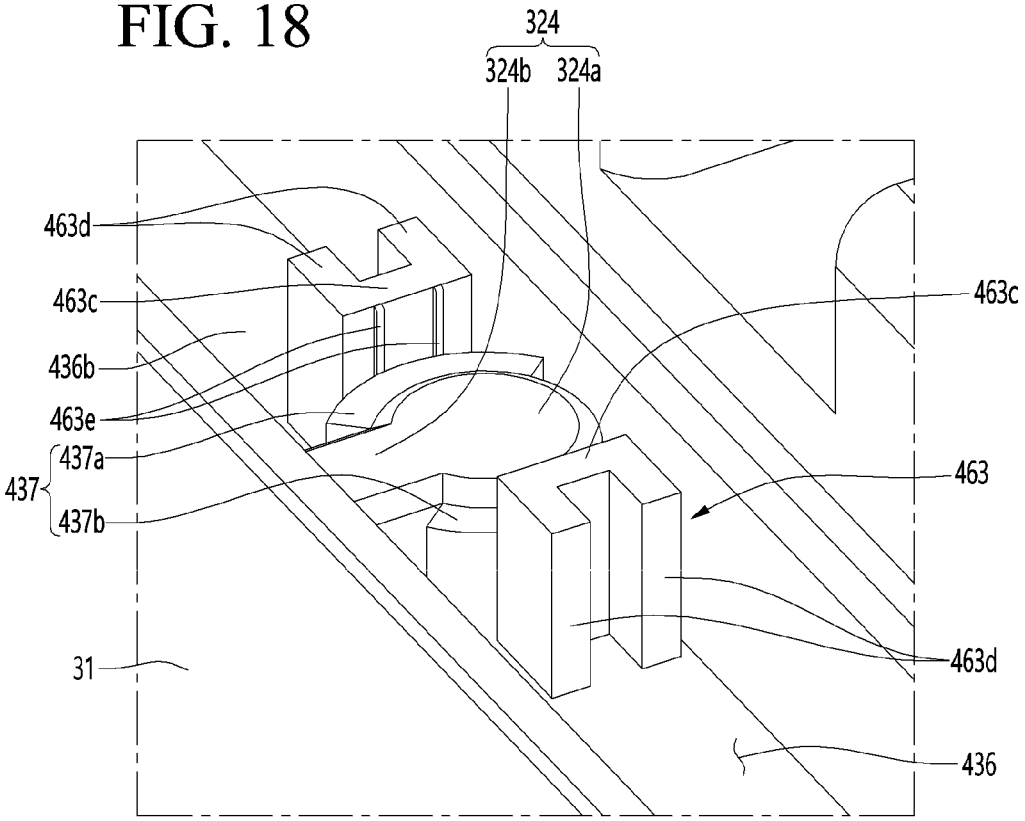
FIG. 18 is an enlarged view of a portion A of FIG. 17.

FIG. 16 is a diagram showing a coupling structure of a mounting protrusion of an upper bracket and a protrusion accommodating part of an upper cap deco. FIG. 17 is a perspective view taken along XVII-XVII' of FIG. 2. FIG. 18 is an enlarged view of a portion A of FIG. 17.

A state before the upper end of the door panel 30 is mounted on the upper cap deco 43 in the state in which the lower end of the door panel 30 is mounted on the lower cap deco 44 is shown in FIG. 16.

In this case, in order to fix the upper end of the door panel 30, the upper end of the door panel 30 may be moved rearward. In this case, in the state in which the lower end of the door panel 30 is restrained, the door panel 30 may be rotated using the lower end of the door panel 30 as an axis.

When the upper end of the door panel 30 is moved rearward, the mounting protrusion 324 protruding from the upper bracket 32 may be moved rearward. Before the mounting protrusion 324 is inserted into the protrusion accommodating part 437, a width D3 of the accommodating part opening may be smaller than a maximum width D2 of the insert part 324*a*. An accommodating part space 437*c* may be equal to or slightly smaller than the maximum width D2 of the insert part 324*a*.

Accordingly, during a process in which the mounting protrusion 324 is inserted into the inside of the protrusion accommodating part 437, the accommodating extensions 437*a* and 437*b* may be elastically deformed while being moved away right and left to pass through the accommodating part opening 437*d*.

When the mounting protrusion 324 is inserted between the accommodating extensions 437*a* and 437*b*, that is, into the inside of the accommodating part space 437*c*, the accommodating extensions 437*a* and 437*b* may be elastically restored to be adhered to surround a perimeter of the insert part 324*a*.

Needless to say, the mounting protrusion 324 may be inserted through an open upper surface of the protrusion accommodating part 437 by moving the door panel 30 up and down rather than rotating the upper end of the door panel 30. In this case, the protrusion accommodating part 437, that is, the accommodating extensions 437*a* and 437*b* may not be elastically deformed.

When the rear surface of the door panel 30, that is, the coupler 321 of the upper bracket 32 is in close contact with the front part 431 of the upper cap deco 43, the mounting protrusion 324 may be completely inserted into the inside of the protrusion accommodating part 437 to be in the state as shown in FIG. 17.

In this case, the door panel 30 may be temporarily fixed to a front surface of the door body 40, and the deco cover 46 may be mounted. In a process in which the deco cover is mounted on the upper cap deco 43, the restraining protrusion 463 may restrain elastic deformation of the protrusion accommodating part 437.

Needless to say, as necessary, the accommodating extensions 437*a* and 437*b* may not be elastically deformed, and in this case, the mounting protrusion 324 may be moved downward from an upper side and may also be inserted into the inside of the protrusion accommodating part 437 through an open upper surface of the protrusion accommodating part 437.

In detail, in a process in which the deco cover 46 is mounted, the restraining members 463*a* and 463*b* may be in contact with the outer surface of the accommodating extensions 437*a* and 437*b* while moving downward. In this case, the insert part 324*a* of the mounting protrusion 324 may be inserted into the inside of the protrusion accommodating part 437. In the state in which the mounting protrusion 324 is inserted into the inside of the accommodating part space 437*c*, a width D4 between the outer surface of the pair of accommodating extensions 437*a* and 437*b* may correspond to the distance D1 between the restraining members.

Accordingly, when the deco cover 46 is completely mounted in the state in which the insert part 324*a* of the mounting protrusion 324 is inserted into the inside of the accommodating part space 437*c*, the restraining members 463*a* and 463*b* may press and fix the accommodating extensions 437*a* and 437*b* from the outside, as shown in FIGS. 17 and 18.

In this case, the restraining members 463*a* and 463*b* may be in contact with both sides of the most protruding portion of the accommodating extensions 437*a* and 437*b*. In particular, when the pair of contact ribs 463*e* presses the outer surface of the accommodating extensions 437*a* and 437*b*, the most protruding portion of the accommodating extensions 437*a* and 437*b* may be disposed in a space between the pair of contact ribs 463*e*.

Thus, in the state in which the restraining members 463*a* and 463*b* are in contact with the outer surface of the accommodating extensions 437*a* and 437*b*, the accommodating extensions 437*a* and 437*b* may not be deformed to the outside. In the state in which the accommodating extensions 437*a* and 437*b* are not elastically deformed, the mounting protrusion 324, that is, the insert part 324*a* may be maintained to be inserted into the inside of the accommodating part space 437*c* and may not be separated from the accommodating part space 437*c*.

That is, in the state in which the deco cover 46 is mounted, the mounting protrusion 324 may be maintained to be inserted into the inside of the accommodating part space 437*c*, and the accommodating extensions 437*a* and 437*b* may be prevented from being deformed, thereby originally preventing the mounting protrusion 324 from being arbitrarily separated.

Accordingly, even if the door 20 is repeatedly opened and closed or an impact is applied to the door 20 when the door 20 is opened and closed, the door panel 30 may be maintained to be firmly and stably mounted without being separated.

When only the deco cover 46 is separated for maintenance or replacement of the door panel 30, the door panel 30 may be easily removed without a separate tool or device, and a necessary operation may be performed quickly.

The embodiment of the present disclosure will be possible in various other embodiments in addition to the above-described embodiment. According to other embodiments of the present disclosure, a door panel or an outer panel defining an exterior may be applied to home appliances other than a refrigerator to change the exterior color of the household appliance. Another embodiment of the present disclosure may differ only in the size and shape of the door panel or outer panel and an object of application, but the structure of the door panel or outer panel is the same, and the same reference numerals are used for the same configuration, and the detailed description thereof is to be omitted.

In embodiments to be described below, the configuration of the door panel, the cap deco, and the deco cover are the same as in the above-described embodiment, and the specific configuration may be understood with reference to the description and drawings of the above-described embodiment, and the detailed description is omitted to avoid repetition.

Hereinafter, other embodiments of the present disclosure will be described with reference to the drawings.

Figure 19:
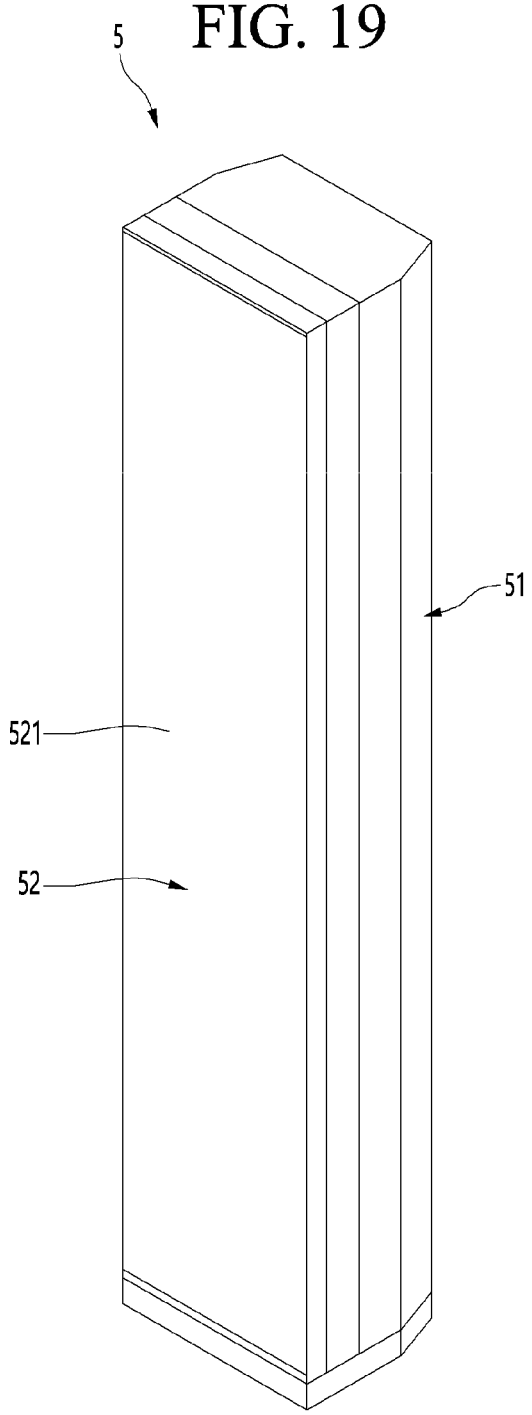
FIG. 19 is a perspective view of an indoor unit of an air conditioner according to another embodiment of the present disclosure.
Figure 20:
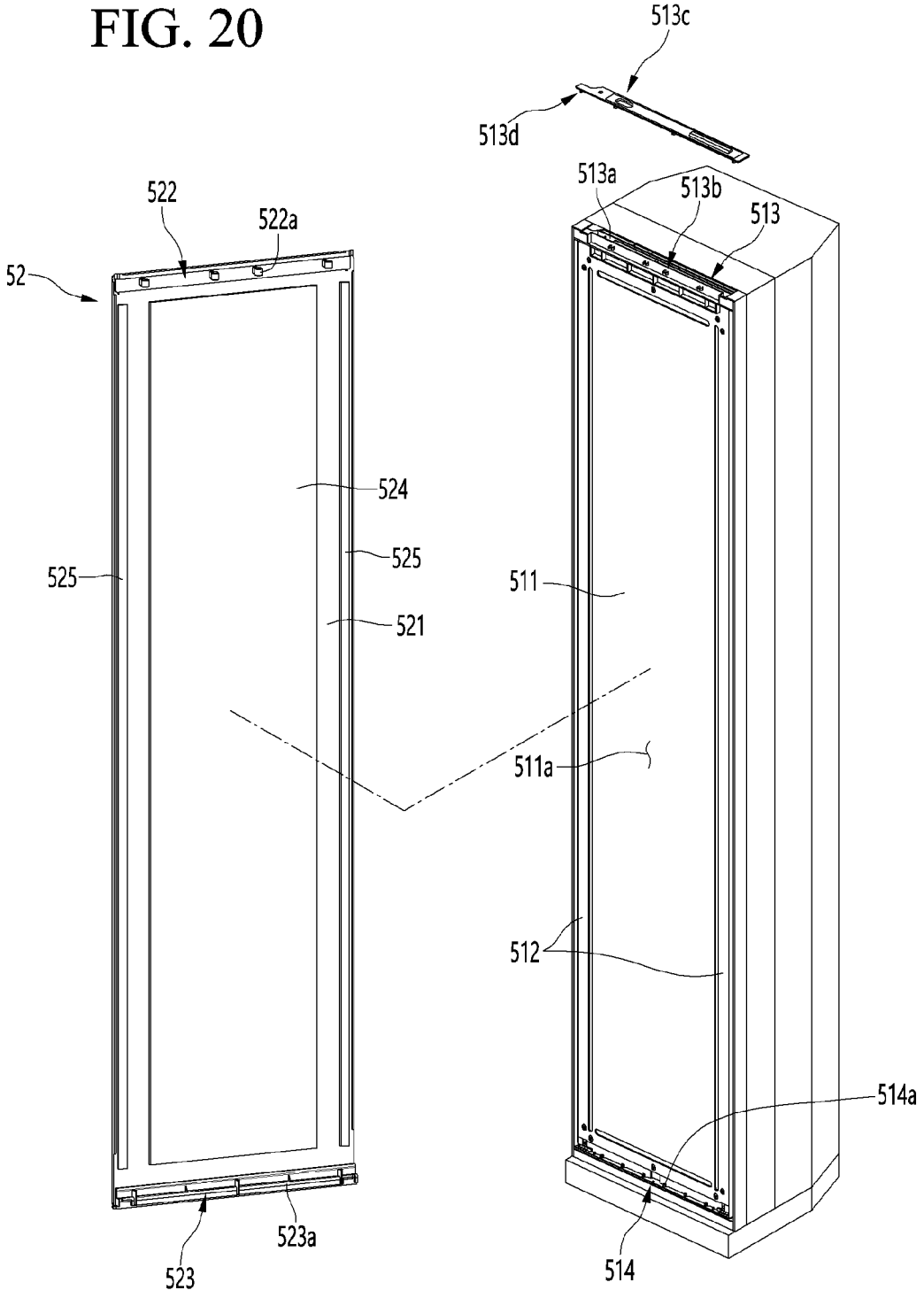
FIG. 20 is an exploded perspective view of an outer panel of the indoor unit.

FIG. 19 is a perspective view of an indoor unit of an air conditioner according to another embodiment of the present disclosure. FIG. 20 is an exploded perspective view of an outer panel of the indoor unit.

As shown in the drawings, an indoor unit 5 of the air conditioner according to another embodiment of the present disclosure may include a case 51 defining an outer appearance, and an outer panel 52 mounted on a front surface of the case 51 and defining a front appearance of the indoor unit 5.

Although not shown in detail, in general, the case 51 may accommodate components constituting a refrigeration cycle including a heat exchanger and a blower fan, and an inlet for sucking indoor air and an outlet for discharging heat-exchanged air into an indoor space may be formed at one side of the case 51.

A side deco defining a side surface may be provided at right and left sides of a case front surface 511, and an upper cap deco 513 and a lower cap deco 514 may be provided at upper and lower ends of the case front surface 511, respectively.

The upper cap deco 513 and the lower cap deco 514 may have the same structure as the upper cap deco 43 and the lower cap deco 44 of the above-described embodiment, only different in size and arrangement.

Accordingly, a protrusion accommodating part 513*b* into which a mounting protrusion 522*a* of an upper bracket 522 is inserted may be formed on a front surface of the upper cap deco 513, and a restraining protrusion 513*d* that is in contact with the protrusion accommodating part 513*b* to maintain a restrained state of the mounting protrusion 522*a* and the protrusion accommodating part 513*b* may protrude downward on a deco cover 513*c* for shielding an opening 513*a* formed on an upper surface of the upper cap deco 513. A catch protrusion 514*a* for coupling with a lower bracket 523 may be formed on the lower cap deco 514.

A side deco 512 may protrude forward from the case front surface 511 to define a panel accommodating space 511*a* in which a panel assembly 52 is accommodated. The outer panel 52 may define a front appearance of the indoor unit 5 and may be disposed in the panel accommodating space 511*a*.

The lower end of the outer panel 52 may be caught and restrained by the lower cap deco 514, and the upper end of the outer panel 52 may be coupled to the upper cap deco 513 to fixedly mount the outer panel 52 on the front surface of the case 51.

The outer panel 52 may have the same structure as the door panel 30 of the above-described embodiment, only different in size as a whole. The outer panel 52 may include a panel 521 defining a front surface, the upper bracket 522 mounted at an upper end of a rear surface of the panel 521, and the lower bracket 523 mounted at a lower end of the rear surface of the panel 521.

The mounting protrusion 522*a* inserted into and mounted on the protrusion accommodating part 513*b* of the upper cap deco 513 may be formed on the upper bracket 522. A lower mounting protrusion 523*a* coupled to the catch protrusion 514*a* of the lower cap deco 514 may be formed on the lower bracket 523.

A support part for supporting the upper end of the panel 521 may be formed on the upper bracket 522, and a lower support part for supporting the lower end of the panel 521 may be formed on the lower bracket 523 to support the panel 521 and to define an outer appearance of the upper and lower ends of the outer panel 52.

Accordingly, in the state in which the outer panel is mounted, the outer panel 52 may define a neat front appearance of the indoor unit 5, and when the outer panel 52 is mounted, it may be possible to easily align and firmly mount the outer panel 52. In addition, the outer panel 52 may be simply separated and mounted to easily change or replace an outer appearance of the indoor unit 5.

A buffer member 524 in contact with the case front surface 511 may be provided on a rear surface of the panel 521. A magnet 525 to be magnetically attached to the case front surface 511 formed of steel may be provided on both right and left sides of the rear surface of the panel 521.

Figure 21:
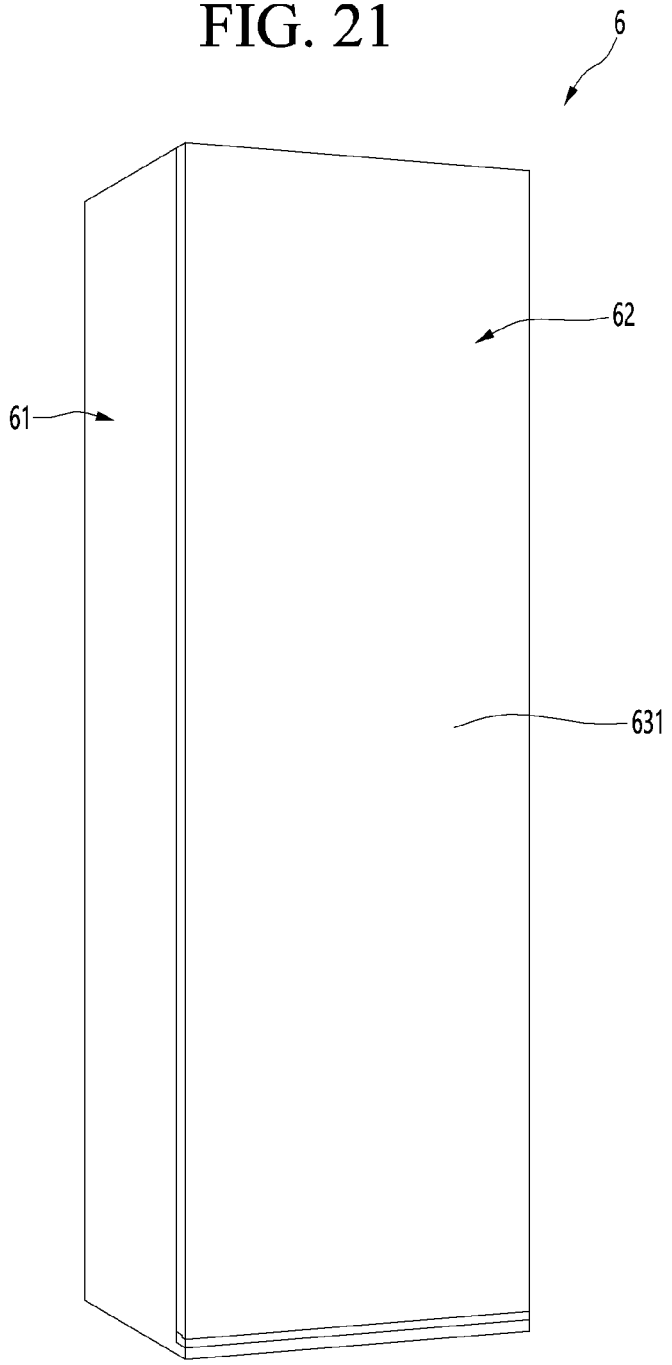
FIG. 21 is a perspective view of a laundry manager according to another embodiment of the present disclosure.
Figure 22:
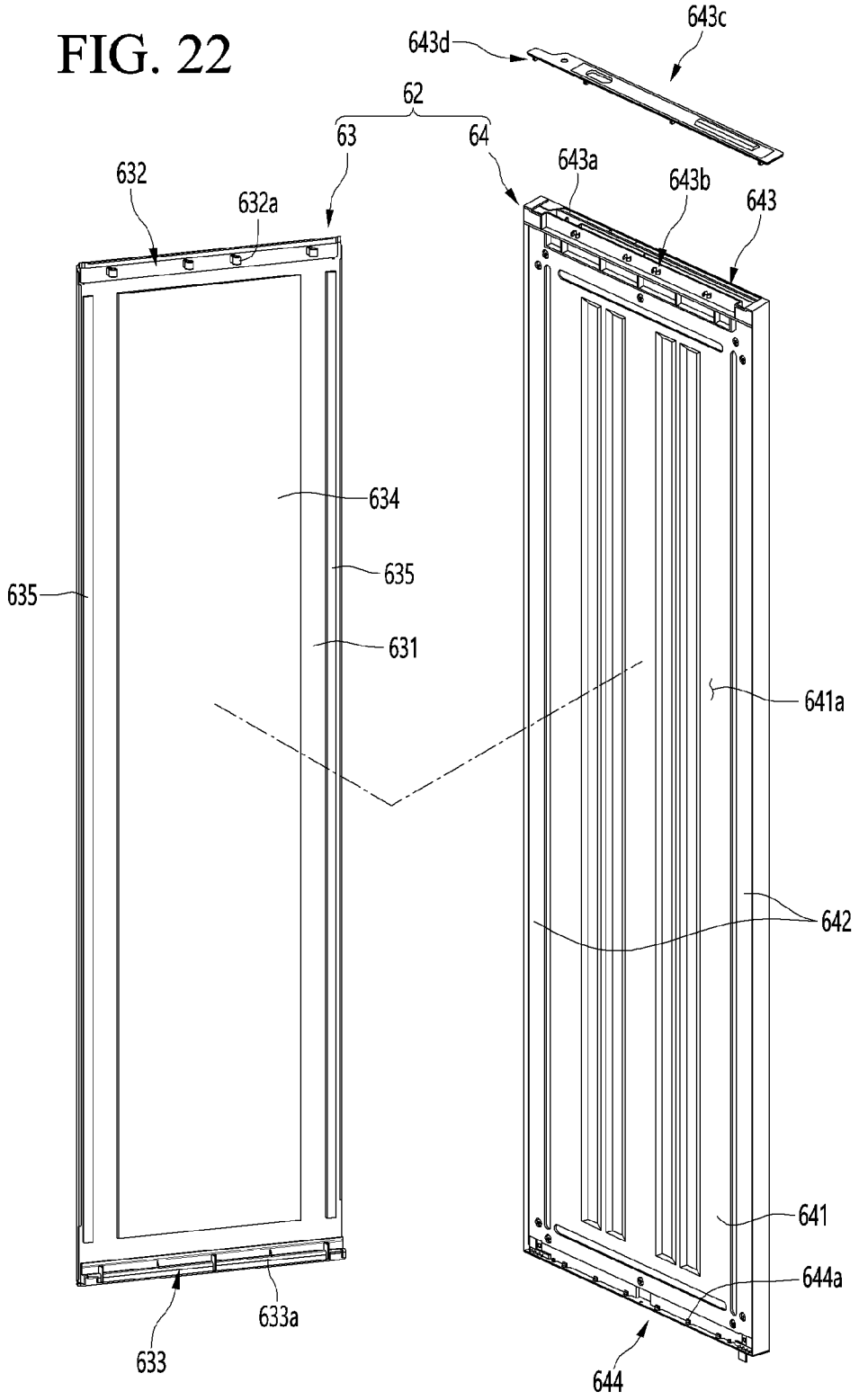
FIG. 22 is an exploded perspective view of a door of the laundry manager.

FIG. 21 is a perspective view of a laundry manager according to another embodiment of the present disclosure. FIG. 22 is an exploded perspective view of a door of the laundry manager.

As shown in the drawing, a laundry manager 6 according to another embodiment of the present disclosure may have an outer appearance defined by a case 61 defining a laundry accommodating space and a door 62 for opening and closing an open front surface of the case 61.

In general, the case 61 may have a laundry accommodating space in which laundry is accommodated, and a heat pump, a water tank, a steam generator, and an air circulation fan may be provided inside a machine room formed separately from the laundry accommodating space.

An outlet for discharging steam generated by the steam generator and dry air heated by the heat pump may be formed inside the laundry accommodating space, and an inlet for sucking air of the laundry accommodating space may be formed therein.

The door 62 may be rotatably mounted on the case 61, and may be configured to define a front appearance of the laundry manager 6 in a state in which the door 62 is closed. In addition, the door 62 may include a door body 63 for opening and closing the laundry accommodating space, and a door panel 63 mounted on the door body 64 to define a front surface of the door 62.

A body plate 641 may be provided on a front surface of the door body 64 to define a front surface of the door body 64. A side deco 642 extending up and down may be provided along both right and left ends of the door body 64. An upper surface of the door body 64 may be formed by an upper cap deco 643 for connecting upper ends of the side deco 642 at both right and left sides, and a lower surface of the door body 64 may be formed by a lower cap deco 644 for connecting lower ends of the side deco 642 at both right and left sides.

The upper cap deco 643 and the lower cap deco 644 may have the same structure as the upper cap deco 43 and the lower cap deco 44 of the above-described embodiment, only different in size and arrangement.

Accordingly, a protrusion accommodating part 643*b* into which a mounting protrusion 632*a* of an upper bracket 632 is inserted may be formed on a front surface of the upper cap deco 643, and a restraining protrusion 643*d* that is in contact with the protrusion accommodating part 643*b* and maintains a restrained state of the mounting protrusion 632*a* and the protrusion accommodating part 643*b* may protrude downward on a deco cover 643*c* for shielding an opening 643*a* formed on an upper surface of the upper cap deco 643. A catch protrusion 644*a* coupling with a lower bracket 633 may be formed on the lower cap deco 644.

The side deco 642 may protrude compared with the front surface of the body plate 641, and a panel accommodating space 641*a* in which the door panel 63 is accommodated may be formed in front of the body plate 641. The door panel 63 may define a front appearance of the laundry manager 6 and may be disposed in the panel accommodating space 641*a*.

A lower end of the door panel 63 may be caught and restrained by the lower cap deco 644, and an upper end of the door panel 63 may be coupled to the upper cap deco 643 to fixedly mount the door panel 63 on the front surface of the case 61.

The door panel 63 may have the same structure as the door panel 30 of the above-described embodiment, only different in size as a whole. The door panel 63 may include a panel 631 defining a front surface, the upper bracket 632 mounted at an upper end of a rear surface of the panel 631, and the lower bracket 633 mounted at a lower end of the rear surface of the panel 631.

The mounting protrusion 632*a* inserted into and mounted on the protrusion accommodating part 643*b* of the upper cap deco 643 may be formed on the upper bracket 632. A lower mounting protrusion 633*a* coupled to the catch protrusion 644*a* of the lower cap deco 644 may be formed on the lower bracket 633.

A support part for supporting the upper end of the panel 631 may be formed on the upper bracket 632, and a lower support part for supporting the lower end of the panel 631 may be formed on the lower bracket 633 to support the panel 631 and to define an outer appearance of the upper and lower ends of the door panel 63.

Accordingly, in the state in which the door panel 63 is mounted, the door panel 63 may define a neat front appearance of the laundry manager 6, and when the door panel 63 is mounted, it may be possible to easily align and firmly mount the door panel 63. In addition, the door panel 63 may be simply separate and mount to easily change or replace an outer appearance of the laundry manager 6.

A buffer member 634 in contact with the body plate 641 may be provided on a rear surface of the panel 631. A magnet 635 to be magnetically attached to the body plate 641 formed of steel may be provided on both right and left sides of the rear surface of the panel 631.

Figure 23:
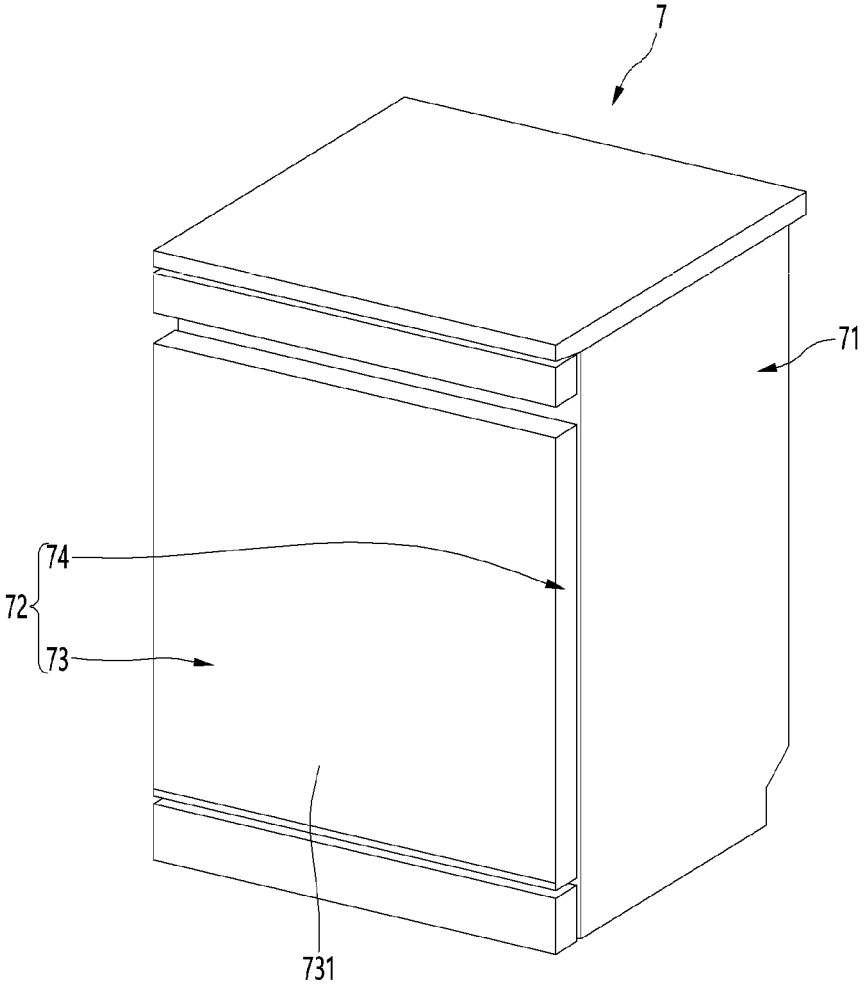
FIG. 23 is a perspective view of a dish washer according to another embodiment of the present disclosure.
Figure 24:
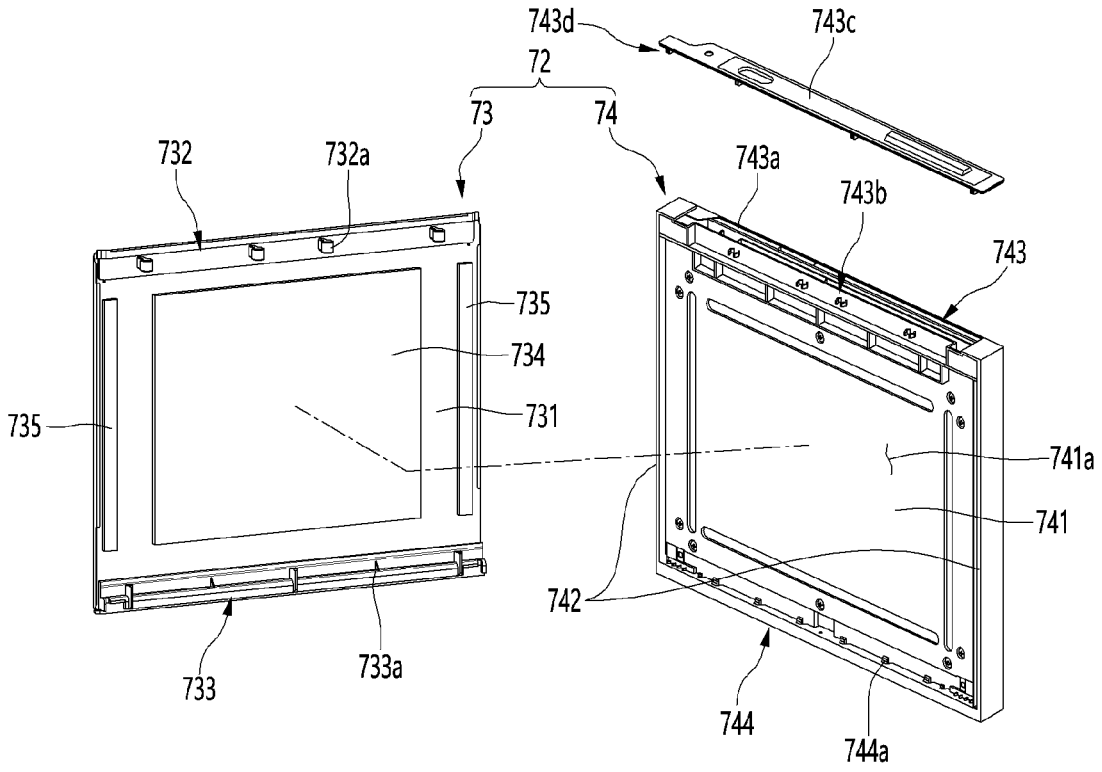
FIG. 24 is an exploded perspective view of a door of the dish washer.

FIG. 23 is a perspective view of a dish washer according to another embodiment of the present disclosure. FIG. 24 is an exploded perspective view of a door of the dish washer.

As shown in the drawings, a dish washer 7 according to another embodiment of the present disclosure may have an outer appearance defined by a case 71 defining a space in which dishes are accommodated and washed, and a door 72 for opening and closing an open front surface of the case 71.

Although not shown in detail, in general, the case 71 may have a washing space therein, a rack that is to be drawn in and out of the washing space and on which dishes are placed, a nozzle for spraying water for washing dishes, and a sump and a water tank for supplying washing water.

A lower end of the door 72 may be rotatably mounted on the case 71, and the door 72 may be configured to define a front appearance of the dish washer 7 in the state in which the door 72 is closed. The door 72 may include a door body 74 for opening and closing the washing space, and a door panel 73 mounted on the door body 74 and defining a front surface of the door 72.

A body plate 741 may be provided on a front surface of the door body 74 to define a front surface of the door body 74. A side deco 742 extending up and down may be provided along both right and left ends of the door body 74. An upper surface of the door body 74 may be formed by an upper cap deco 743 for connecting upper ends of the side deco 742 at both right and left sides, and a lower surface of the door body 74 may be formed by a lower cap deco 744 for connecting lower ends of the side deco 742 at both right and left sides.

The upper cap deco 743 and the lower cap deco 744 may have the same structure as the upper cap deco 43 and the lower cap deco 44 of the above-described embodiment, only different in size and arrangement.

Accordingly, a protrusion accommodating part 743*b* into which a mounting protrusion 732*a* of an upper bracket 732 is inserted may be formed on a front surface of the upper cap deco 743, and a restraining protrusion 743*d* that is in contact with the protrusion accommodating part 743*b* to maintain a restrained state of the mounting protrusion 732*a* and the protrusion accommodating part 743*b* may protrude downward on a deco cover 743*c* for opening and closing an opening 743*a* formed on an upper surface of the upper cap deco 743. A catch protrusion 744*a* for coupling with a lower bracket 733 may be formed on the lower cap deco 744.

The side deco 742 may protrude compared with a front surface of the body plate 741, and a panel accommodating space 741*a* in which the door panel 73 is accommodated may be formed in front of the body plate 741. The door panel 73 may define a front appearance of the dish washer 7 and may be disposed in the panel accommodating space 741*a*.

The lower end of the door panel 73 may be caught and restrained by the lower cap deco 744, and the upper end of the door panel 73 may be coupled to the upper cap deco 743 to fixedly mount the door panel 73 on the front surface of the case 71.

The door panel 73 may have the same structure as the door panel 30 of the above-described embodiment, only different in size as a whole. The door panel 73 may include a panel 731 defining a front surface, the upper bracket 732 mounted at a lower end of the rear surface of the panel 731, and the lower bracket 733 mounted at a lower end of the rear surface of the panel 731.

The mounting protrusion 732*a* inserted into and mounted on the protrusion accommodating part 743*b* of the upper cap deco 743 may be formed on the upper bracket 732. A lower mounting protrusion 733*a* coupled to the catch protrusion 744*a* of the lower cap deco 744 may be formed on the lower bracket 733.

A support part for supporting the upper end of the panel 731 may be formed on the upper bracket 732, and a lower support part for supporting the lower end of the panel 731 may be formed on the lower bracket 733 to support the panel 731 and to define an outer appearance of the upper and lower ends of the door panel 73.

Accordingly, in the state in which the door panel 73 is mounted, the door panel 73 may define a neat front appearance of the dish washer 7, and when the door panel 73 is mounted, it may be possible to easily align and firmly mount the door panel 73. In addition, the door panel 73 may be simply separated and mounted to easily change or replace an outer appearance of the dish washer 7.

A buffer member 734 in contact with the body plate 741 may be provided on a rear surface of the panel 731. A magnet 735 to be magnetically attached to the body plate 741 formed of steel may be provided on both right and left sides of the rear surface of the panel 731.

Figure 25:
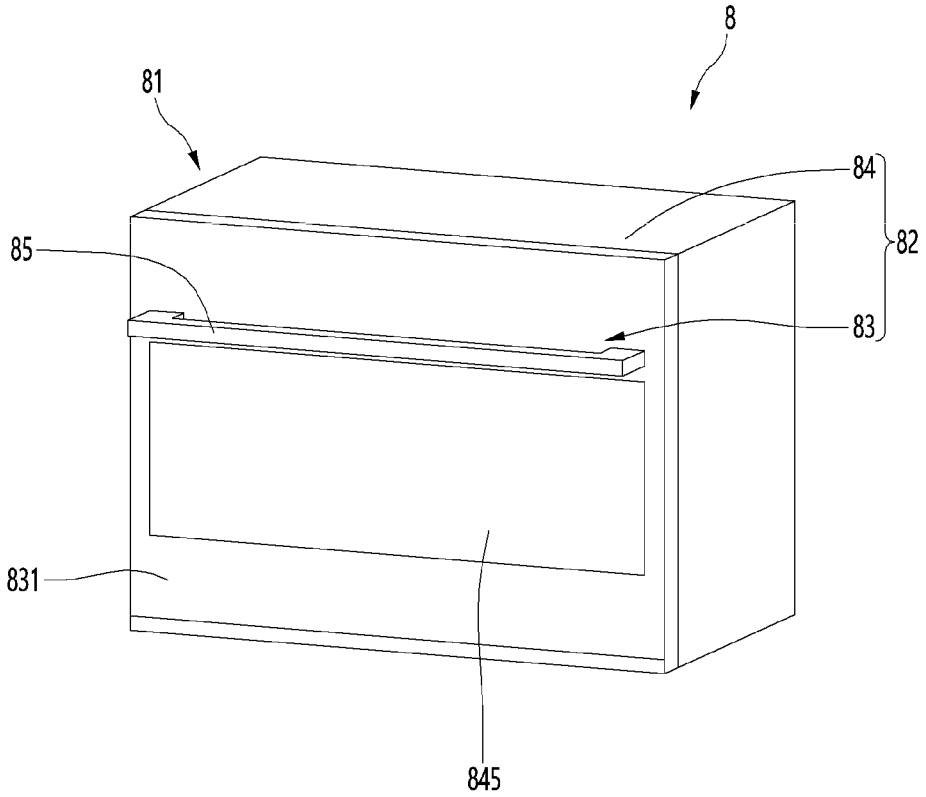
FIG. 25 is a perspective view of a cooking device according to another embodiment of the present disclosure.
Figure 26:
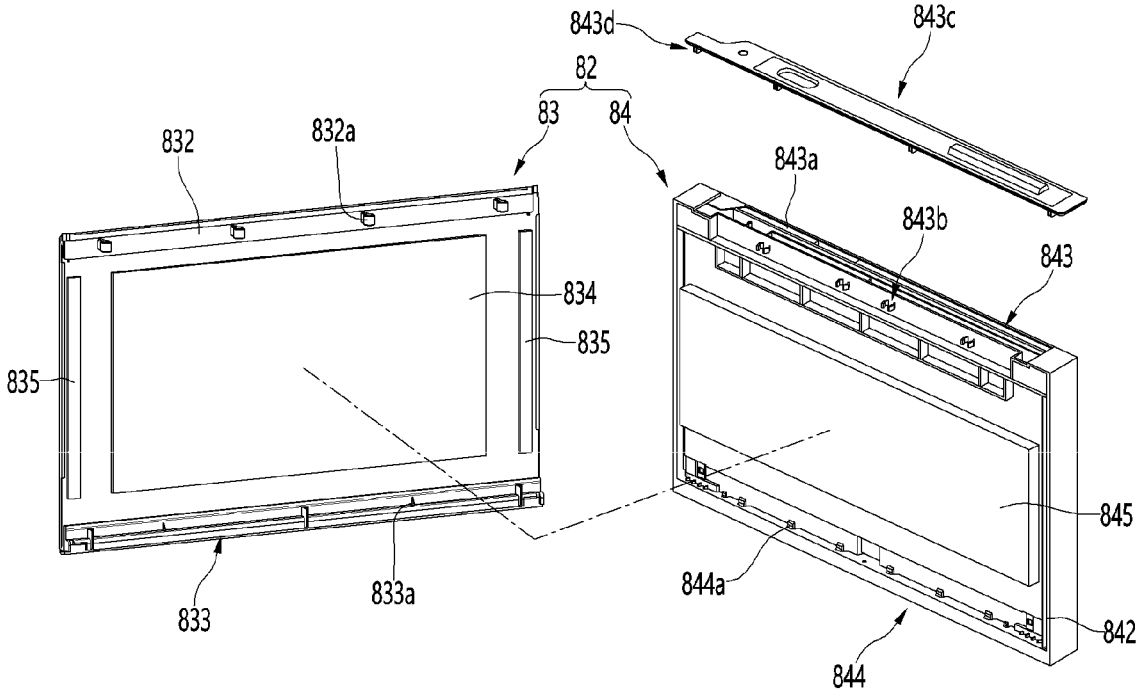
FIG. 26 is an exploded perspective view of a door of the cooking device.

FIG. 25 is a perspective view of a cooking device according to another embodiment of the present disclosure. FIG. 26 is an exploded perspective view of a door of the cooking device.

As shown in the drawing, a cooking device 8 according to another embodiment of the present disclosure may have an outer appearance defined by a case 81 defining a space in which food is accommodated and cooking is performed, and a door 82 for opening and closing an open front surface of the case 81.

Although not shown in detail, in general, the case 81 may have a cooking space therein, a heater or a magnetron for cooking food in the cooking space, a fan for air circulation inside the cooking space, or a turntable on which food is accommodated and rotated.

The door 82 may be rotatably mounted on the case 81 and may be configured to define a front appearance of the cooking device 8 in the state in which the door 82 is closed. The door 82 may include a door body 84 for opening and closing the cooking space, and a door panel 83 mounted on the door body 84 and defining a front surface of the door 82.

A body plate 841 may be provided on a front surface of the door body 84 to define a front surface of the door body 84. A side deco 842 extending up and down may be provided along both right and left ends of the door body 84. An upper surface of the door body 84 may be formed by an upper cap deco 843 for connecting upper ends of the side deco 842 at both right and left sides, and a lower surface of the door body 84 may be formed by a lower cap deco 844 for connecting lower ends of the side deco 842 at both right and left sides.

A sight window 845 for viewing the cooking space may be formed at approximately the center of the door body 84.

The upper cap deco 843 and the lower cap deco 844 may have the same structure as the upper cap deco 43 and the lower cap deco 44 of the above-described embodiment, only different in size and arrangement.

Accordingly, a protrusion accommodating part 843*b* into which a mounting protrusion 832*a* of an upper bracket 832 is inserted may be formed on a front surface of the upper cap deco 843, and a restraining protrusion 843*d* that is in contact with the protrusion accommodating part 843*b* to maintain a restrained state of the mounting protrusion 832*a* and the protrusion accommodating part 843*b* may protrude downward on a deco cover 843*c* for opening and closing formed on an upper surface of the upper cap deco 843. A catch protrusion 844*a* for coupling with a lower bracket 833 may be formed on the lower cap deco 844.

The side deco 842 may protrude compared with a front surface of the body plate 841, and a panel accommodating space 841*a* in which the door panel 83 is accommodated may be formed in front of the body plate 841. The door panel 83 may define a front appearance of the cooking device 8 and may be disposed in the panel accommodating space 841*a*.

The lower end of the door panel 83 may be caught and restrained by the lower cap deco 844, and the upper end of the door panel 83 may be coupled to the upper cap deco 843 to fixedly mount the door panel 83 on the front surface of the case 81.

The door panel 83 may have the same structure as the door panel 30 of the above-described embodiment, only different in size as a whole. The door panel 83 may include a panel 831 defining a front surface, the upper bracket 832 mounted at a lower end of the rear surface of the panel 831, and the lower bracket 833 mounted at a lower end of the rear surface of the panel 831.

The mounting protrusion 832*a* inserted into and mounted on the protrusion accommodating part 843*b* of the upper cap deco 843 may be formed on the upper bracket 832. A lower mounting protrusion 833*a* coupled to the catch protrusion 844*a* of the lower cap deco 844 may be formed on the lower bracket 833.

A support part for supporting the upper end of the panel 831 may be formed on the upper bracket 832, and a lower support part for supporting the lower end of the panel 831 may be formed on the lower bracket 833 to support the panel 831 and to define an outer appearance of the upper and lower ends of the door panel 83.

Accordingly, in the state in which the door panel 83 is mounted, the door panel 83 may define a neat front appearance of the cooking device 8, and when the door panel 83 is mounted, it may be possible to easily align and firmly mount the door panel 83. In addition, the door panel 83 may be simply separated and mounted to easily change or replace an outer appearance of the cooking device 8.

A buffer member 834 in contact with the body plate 841 may be provided on a rear surface of the panel 831. A magnet 835 to be magnetically attached to the body plate 841 formed of steel may be provided on both right and left sides of the rear surface of the panel 831.

A panel opening 836 may be formed on the panel 831. The panel opening 836 may be formed with a corresponding size at a position corresponding to the sight window 845. Thus, when a door panel 93 is mounted, a sight window 945 may be exposed forward through the panel opening 836.

A handle 85 for opening and closing the door 82 may be further provided on a front surface of the panel 831.

The following effects may be expected in the refrigerator and the home appliance according to the proposed embodiment.

In the refrigerator according to an embodiment of the present disclosure, a panel bracket may be coupled to an end of a panel defining a front surface of a door, and the panel bracket may support the end of the panel and may simultaneously define an end of the door.

Thus, the end of the pane and a support part of the panel bracket may be mounted on the door body in the state of being in close contact with each other, and an interval is not formed between the pane and the support part and an adhered state therebetween may be maintained. Due to this structure, viewed from the front, the door panel may maintain an outer appearance in the state in which the end of the pane and the support part are in close contact with each other, and accordingly, an outer appearance may be advantageously improved and assembly finish quality may be advantageously improved.

In particular, the door bracket may be already attached to the panel to complete the finish before the door panel is mounted, and accordingly, even after the door panel is mounted on the door body, the interval between the panel and the support part may not be widened or deformed, and the state in which the panel and the support part are first coupled may be maintained, thereby advantageously maintaining the finished quality.

When the panel is formed of a metal plate, a bending part bent at an end of the pane may be covered by attaching the panel bracket. Accordingly, it may be possible to prevent a user from being injured by a sharp end of the panel during a transporting and assembling process for mounting the door panel, and the work safety of an operator may be advantageously ensured.

An end of the panel may be supported by the support part, and thus may be prevented from being directly exposed to the outside. Thus, even if an external impact is applied to an end of the door panel, the door panel may be protected by the support part, and the panel may be advantageously prevented from being damaged.

The door panel may be disposed at an end of a rear surface of the panel bracket in the state of being mounted on the door body, and the panel bracket may be supported by a front surface of the upper cap deco of the door. Thus, even if a load is applied to the end of the door panel or the door panel is compressed and pressed, the door panel may be supported by the upper cap deco from the rear, thereby advantageously preventing the panel from being deformed and damaged.

Upper and lower ends of the door panel may be fixedly mounted on an upper cap deco and a lower cap deco, respectively, and the door panel may be fixedly mounted on the door body by moving and manipulating the door panel without a separate tool.

In particular, the restraining protrusion may be inserted into the lower mounting protrusion space by moving the door panel up and down, and a mounting protrusion may be inserted into the protrusion accommodating part, and accordingly, the door panel may be easily separated and mounted without a separate tool. Thus, the assembly workability of the door panel may be improved, and maintenance may be easily performed. In addition, even if the door panel is to be replaced, the door panel may be replaced and mounted through a very simple operation.

The mounting protrusion may be integrally formed with the panel bracket together with the support part for supporting the panel, and it may be possible to fixedly mount the door panel as well as to define an outer appearance of the door by the panel bracket. Thus, man-hours may be advantageously reduced by reducing the number of parts of a product, and manufacturing cost may be advantageously reduced.

When the deco cover is mounted in the state in which the door panel is mounted, a restraining protrusion of the deco cover may press and fix the protrusion accommodating part and may prevent an accommodation member included in the protrusion accommodating part from being deformed. Thus, when the protrusion accommodating part is restrained by the restraining protrusion in the state in which the mounting protrusion is inserted into the inside of the protrusion accommodating part, the protrusion accommodating part may be prevented from being deformed, and thus the mounting protrusion may be prevented from being arbitrarily separated from the protrusion accommodating part.

Accordingly, the door panel may maintain the state of being more firmly mounted on the door body, and even if the door panel is repeatedly opened and closed or a large load is applied to the door panel when the door panel is opened and closed, the door panel may be advantageously prevented from being separated from the door body.

What is claimed is:

1. A refrigerator comprising:

a cabinet defining a storage space;

a door assembly configured to open and close at least a portion of the storage space and comprising (i) a door body and (ii) a door panel detachably coupled to the door body, wherein the door panel comprises:

a front panel defining a front appearance of the door assembly, and a panel bracket disposed at a rear surface of the front panel and comprising a mounting protrusion that protrudes toward the door body, and wherein the door body comprises:

a cap deco that is provided at an upper side of the door body, that defines a recess, and that includes a protrusion accommodating part at the recess, the protrusion accommodating part being configured to receive the mounting protrusion; and a deco cover disposed at an upper portion of the cap deco and comprising a restraining protrusion that protrudes to the cap deco and that is configured to, based on the deco cover being coupled to the cap deco, block the mounting protrusion and the protrusion accommodating part from being separated from each other; wherein the mounting protrusion is configured to, based on the mounting protrusion inserting into the protrusion accommodating part, laterally expand outward or elastically deform the protrusion accommodating part.

2. The refrigerator of claim 1, wherein the mounting protrusion is configured to be inserted into the protrusion accommodating part in a first direction, and wherein the mounting protrusion is configured to, based on the mounting protrusion inserting into the protrusion accommodating part, elastically deform the protrusion accommodating part in a second direction that crosses the first direction.

3. The refrigerator of claim 1, wherein the protrusion accommodating part is configured to, based on the mounting protrusion being inserted into the protrusion accommodating part, surround at least a portion of the mounting protrusion.

4. The refrigerator of claim 1, wherein the protrusion accommodating part includes a pair of accommodating extensions that are spaced apart from each other.

5. The refrigerator of claim 4, wherein the pair of accommodating extensions extend to the door panel and are configured to move away from each other based on the mounting protrusion being inserted into a space defined between the pair of accommodating extensions.

6. The refrigerator of claim 4, wherein front ends of the pair of accommodating extensions are spaced apart from each other to define an opening into which the mounting protrusion is inserted.

7. The refrigerator of claim 4, wherein a distance between middle portions of the pair of accommodating extensions is greater than a distance between front ends of the pair of accommodating extensions, the middle portions being disposed rearward from the door panel with respect to the front ends of the pair of accommodating extensions.

8. The refrigerator of claim 1, wherein the protrusion accommodating part has a plate shape having a predetermined thickness.

9. The refrigerator of claim 1, wherein the mounting protrusion includes an insert part configured to be inserted into the protrusion accommodating part.

10. The refrigerator of claim 9, wherein a width of the insert part decreases from a central part of the insert part toward (i) a first end of the insert part and (ii) a second end of the insert part.

11. The refrigerator of claim 9, wherein a perimeter surface of the insert part is inclined or rounded.

12. The refrigerator of claim 9, wherein the mounting protrusion further includes an extension extending from a rear surface of the panel bracket toward the door body.

13. The refrigerator of claim 12, wherein a width of the insert part is greater than a width of the extension.

14. The refrigerator of claim 12, wherein the insert part and the extension extend in a vertical direction at a same length.

15. The refrigerator of claim 1, wherein the recess is provided at an upper front edge of the cap deco.

16. The refrigerator of claim 1, wherein the recess (i) includes a lower surface and a rear surface and (ii) defines an opening at a front side and an upper side, the lower and rear surfaces and the openings at the front and upper side spaces defining a space in which at least a portion of the mounting protrusion is received.

17. The refrigerator of claim 1, wherein the restraining protrusion is configured to, based on the deco cover being coupled to the cap deco, contact the protrusion accommodating part to block expansion of the protrusion accommodating part.

18. The refrigerator of claim 1, wherein the restraining protrusion comprises a pair of restraining extensions that are spaced apart from each other, and wherein the pair of restraining extensions are configured to, based on the deco cover being coupled to the cap deco, receive the protrusion accommodating part and the mounting protrusion therebetween.

* * * * *